US008002401B2

(12) United States Patent
Moriyama et al.

(10) Patent No.: US 8,002,401 B2
(45) Date of Patent: Aug. 23, 2011

(54) SHEET PROCESSING APPARATUS AND IMAGE FORMING APPARATUS

(75) Inventors: Tsuyoshi Moriyama, Toride (JP); Hitoshi Kato, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 1203 days.

(21) Appl. No.: 11/672,474

(22) Filed: Feb. 7, 2007

(65) Prior Publication Data

US 2007/0183828 A1 Aug. 9, 2007

(30) Foreign Application Priority Data

Feb. 9, 2006 (JP) ..... 2006-032882

(51) Int. Cl.
*B65H 39/055* (2006.01)

(52) U.S. Cl. ..... 347/104; 270/58.08; 270/58.09; 399/410

(58) Field of Classification Search ..... 347/104; 399/410; 270/58.08, 58.09
See application file for complete search history.

(56) References Cited

U.S. PATENT DOCUMENTS 4,160,887 A * 7/1979 van Buren, Jr. ..... 200/61.62
4,378,085 A * 3/1983 McVeigh ..... 227/79
4,844,319 A * 7/1989 Kurosawa ..... 227/79
7,472,899 B2 * 1/2009 Moriyama et al. ..... 270/58.08
2006/0017210 A1 * 1/2006 Sato et al. ..... 270/58.08
2008/0035699 A1 * 2/2008 Shimizu et al. ..... 227/93

FOREIGN PATENT DOCUMENTS

JP 2001-105347 4/2001
JP 2006168185 A * 6/2006

OTHER PUBLICATIONS

Machine Language Translation of JP 2006-168185A, http://dossier.ipdl.inpit.go.jp/text_trans.html, Printed Sep. 22, 2010.*

* cited by examiner

*Primary Examiner* — Matthew Luu
*Assistant Examiner* — Rut Patel
(74) *Attorney, Agent, or Firm* — Canon USA Inc IP Division

(57) ABSTRACT

A sheet processing apparatus includes a stapler configured to staple a bundle of sheets by driving a staple into the sheet bundle; a cutting mechanism configured to cut off portions of staples driven into the sheet bundle; a storage portion configured to store cut-off portions of staples; a lid mounted on the storage portion capable of opening and closing; an open and closed state detecting portion configured to detect open and closed state of the lid; a collecting portion configured to collect cut-off portions of staples from the storage portion; and a lid opening and closing portion configured to open the lid when cut-off portions of staples are collected, wherein after the lid opening and closing portion has performed a lid opening and closing motions, if the open and closed state detecting portion detects that the lid is not closed, the lid opening and closing portion repeats a lid opening and closing operation.

15 Claims, 20 Drawing Sheets

SHEET PROCESSING APPARATUS AND IMAGE FORMING APPARATUS

BACKGROUND OF THE INVENTION

1. Field of the Invention

The present invention relates to a sheet processing apparatus and an image forming apparatus capable of cutting off end portions of staples used for binding sheets, and more particularly to a sheet processing apparatus and an image forming apparatus capable of surely closing the lid which is opened when the cut-off end portions of staples are disposed of.

2. Description of the Related Art

An image forming apparatus, such as a copying machine and printer, can include a sheet processing apparatus adapted to selectively perform a stapling process or a punching process to sheets on which an image has been formed, so as to reduce work required for the stapling process or the like on image carrying sheets.

The conventional sheet processing apparatus which can perform a stapling process, can include a stapler capable of stapling a sheet bundle at one or more than one points.

In such a sheet processing apparatus, a predetermined number of image carrying sheets are transported to the process tray, and the sheets are aligned. Then, the stapler is moved to a predetermined position at an edge of the aligned sheet bundle, and the stapler drives staples into the sheet bundle to bind the sheets.

When sheets are bound, if a small number of sheets is bound together using long-leg staples, two end portions of each staple overlap one another. To prevent the overlapping of staple legs, conventional staplers have a mechanism to cut off surplus legs. More specifically, when staples are driven through the sheet bundle, they extend to the air on the opposite side of the sheet bundle. With respect to the extending staple, only the portions of staples necessary for stapling are preserved, and after surplus portions are cut off, the remaining portions are clinched to fasten the sheets together (refer to Japanese Patent Application Laid-Open No. 2001-105347, for example).

In such a stapler, cut-off end portions H of staples are accumulated in a storage box 510 provided at a stapler 501 as shown in FIG. 20. If a stapling job is continuously performed, the storage box 510 becomes full. In this case, it is necessary to store the cut-off end portions H of staples into a large capacity storage box 600 before the storage box 510 becomes full.

When the cut-off end portions H of staples are stored in the large capacity storage box 600, the storage box 510 is moved above the large capacity storage box 600, and the open-close lid 520 provided for the movable box 510 is opened. As the open-close lid 520 is opened, the cut-off end portions H of staples fall from the storage box 510 into the large capacity storage box 600 and collected therein.

In the conventional sheet processing apparatus and image forming apparatus, after the cut-off waste end portions H are collected in the large capacity storage box 600, the open-close lid 520 is closed, and then the stapler 501 starts a stapling operation.

However, when the staple end portions H are collected into the large capacity storage box 600, the staple end portions H sometimes can be caught in the open-close lid 520. In this case, the open-close lid 520 cannot be completely closed, and a space is made between the storage box 510 and the open-close lid 520. Under this condition, if the stapling operation is performed and the cut-off end portions H accumulate in the storage box 510, the end portions H can drop off through the space between the storage box 510 and the open-close lid 520.

Also in a stapling operation, the open-close lid 520 can open for some reason. If the open-close lid 520 opens, the staple end portions H are scattered from the storage box 510.

SUMMARY OF THE INVENTION

The present invention is directed to a sheet processing apparatus and an image forming apparatus in which the open-close lid can be unfailingly closed.

According to an aspect of the present invention, a sheet processing apparatus includes a stapler configured to staple a bundle of sheets by driving a staple into the sheet bundle; a cutting mechanism configured to cut off end portions of a staple driven into the sheet bundle; a storage portion storing cut-off end portions of staples; a lid mounted on the storage portion capable of opening and closing; an open and closed state detecting portion configured to detect open and closed states of the lid; a collecting portion configured to collect cut-off end portions of staples from the storage portion; and a lid opening and closing portion configured to open the lid when the cut-off staple portions are collected from the storage portion to the collecting portion, wherein after the lid opening and closing portion has performed a lid opening and closing operation of a lid opening motion and then a lid closing motion, if the open and closed state detecting portion detects that the lid is not closed, the lid opening and closing portion repeats the lid opening and closing operation.

According to another aspect of the present invention, the image forming apparatus includes an image forming portion configured to form an image on a sheet; and a sheet processing apparatus configured to process a sheet having an image formed by the image forming portion, wherein the sheet processing apparatus is as described above.

According to an embodiment of the present invention, after the end portions of staples temporarily stored in the storage portion are collected into the collecting portion, if it is detected that the lid is still open, the lid is opened and closed again, and the sheet processing apparatus can cause cut-off staple portions adhering to the lid to fall into the collecting portion. Consequently, the lid can be closed assuredly. Thus, it is possible to prevent cut-off staple portions from dropping off through the space between the storage portion and the lid, so that the ease of use of the apparatus is improved.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DETAILED DESCRIPTION OF THE EMBODIMENTS

Various exemplary embodiments, features, and aspects of the invention will be described in detail below with reference to the drawings.

First Exemplary Embodiment

Figure 1:
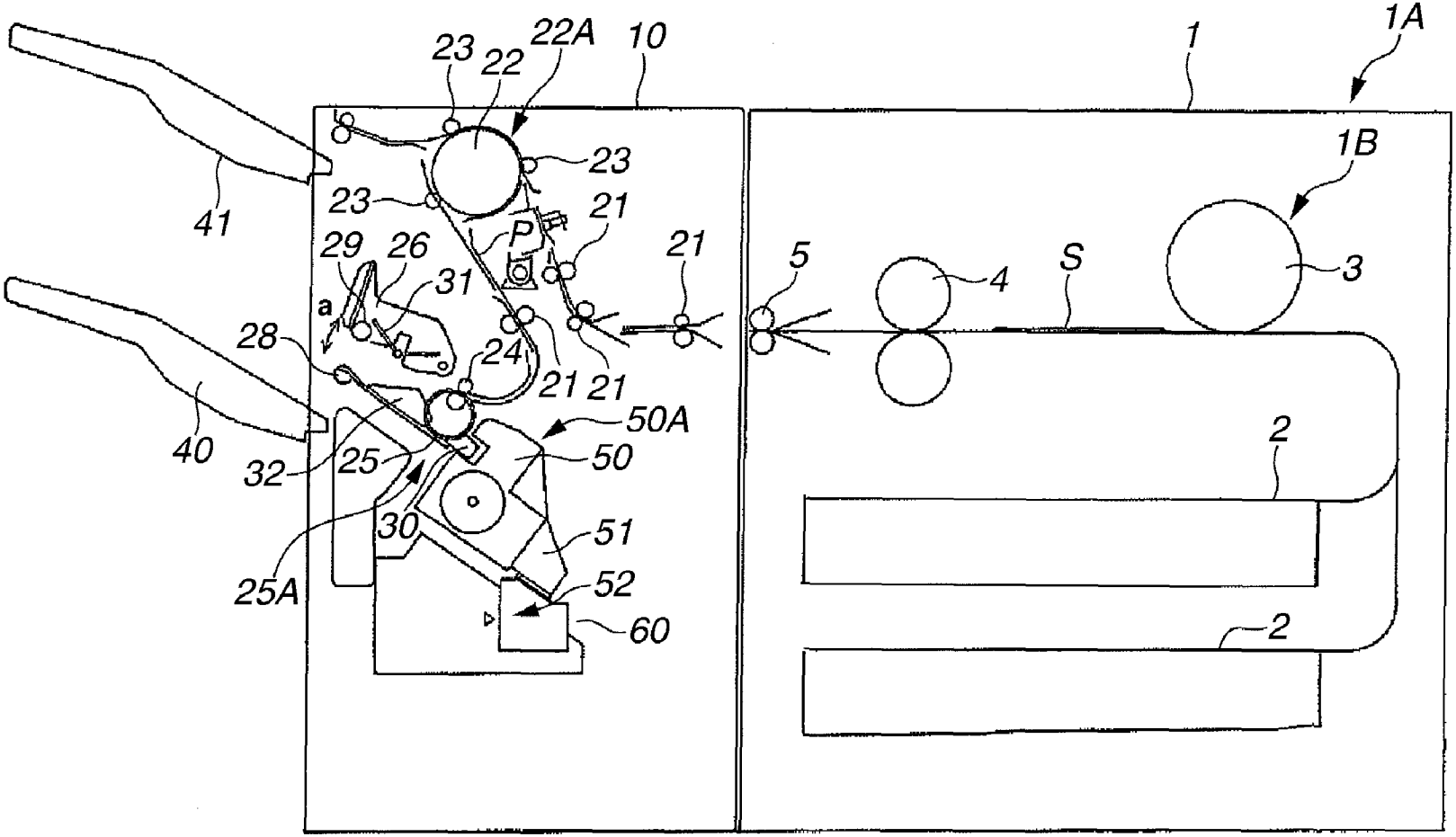
FIG. 1 is a diagram showing a structure of a copying machine as an example of an image forming apparatus including a sheet processing apparatus according to an embodiment of the present invention.

FIG. 1 is a diagram showing a structure of a copying machine as an example of an image forming apparatus including a sheet processing apparatus according to an embodiment of the present invention.

FIG. 1 shows a copying machine 1A as the image forming apparatus. The copying machine 1A is formed by mounting a sheet processing apparatus 10 to a copying machine main body 1. In the copying machine 1A, when an image forming operation is started, a toner image is formed on a photosensitive drum 3, which constitutes an image forming portion 1B. The toner image is transferred onto a sheet S supplied from a paper supply portion 2.

The sheet S, onto which the toner image has been transferred, is sent to a fixing device 4. The fixing device 4 fixes the toner image on the sheet, and then the sheet S is discharged with a pair of discharge rollers 5 to the sheet processing apparatus 10.

The sheet processing apparatus 10 accepts one sheet S after another as they are discharged from the copying machine main body 1. The sheet processing apparatus 10 performs a bundling process of aligning and bundling accepted sheets into a sheet bundle, and a stapling process of stapling the sheet bundle together. Other processes on the sheet bundle, such as sorting, punching, and book binding, are also performed in the sheet processing apparatus 10. This sheet processing apparatus 10 includes a buffer roller 22A and a process tray unit 25A having a process tray serving as a paper stacking portion, which will be described below.

While sheets on a process tray 25 are being processed, the buffer roller portion 22A stacks one or more sheets up which are on stand-by for the next process. After the on-going process is completed, the buffer roller portion 22A transfers the sheet or sheets on stand-by toward the process tray 25. The buffer roller portion 22A includes a buffer roller 22 and a plurality of small buffer rollers 23 to press the sheet against the buffer roller 22.

The process tray unit 25A includes the process tray 25, a pair of discharge rollers 24, aligning members 32, and a return paddle 31. The process tray 25 temporarily accumulates, aligns, and staples the sheets. The pair of discharge rollers 24 discharges sheets onto the process tray 25. The process tray unit 25A also includes a binding unit 50A equipped with a stapler 50. The stapler 50 fastens a bundle of sheets when necessary by driving staples into the sheets stacked on the process tray 25.

The process tray 25 can be an inclined tray with its downstream side (on the left of FIG. 1) located at a higher position and its upstream side (on the right of FIG. 1) at a lower position. A rear end aligning member 30 is located at the lower end of the tray. When a sheet is discharged to the process tray 25 by the discharge roller pair 24, the discharged sheet slides down the process tray 25 under the sheet's own weight and also by the action of the paddle 31 until it comes into contact with the rear-end aligning member 30.

Figure 2:
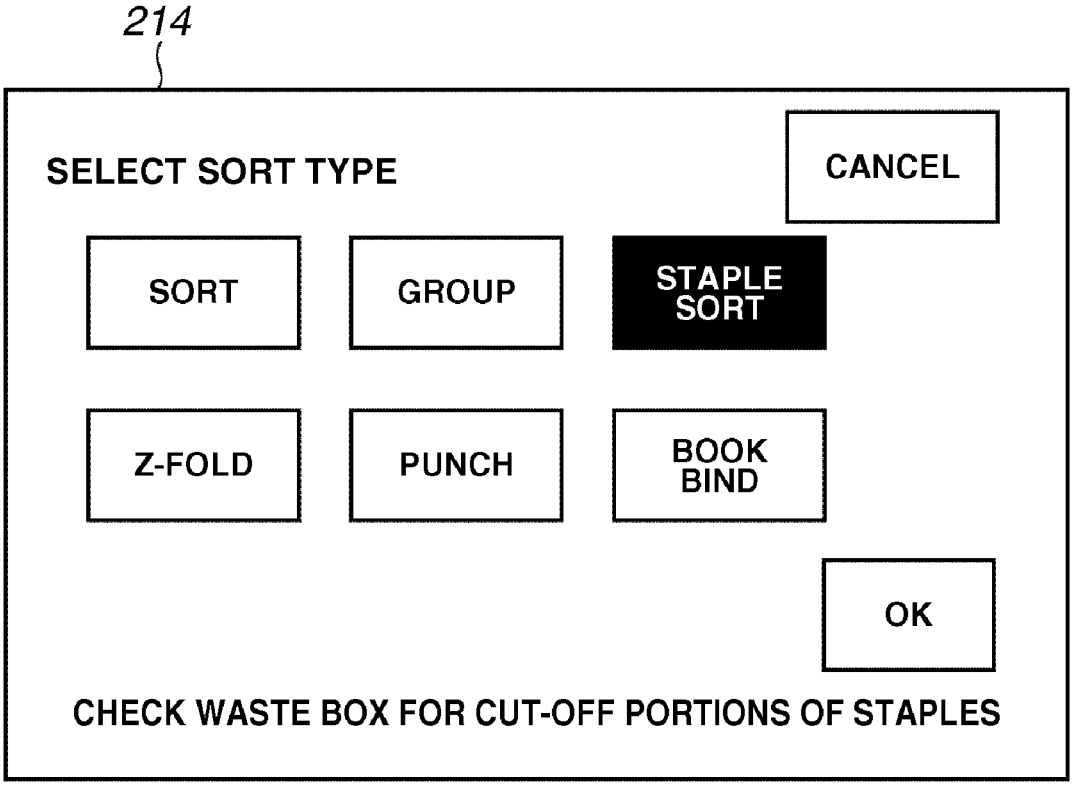
FIG. 2 is a diagram showing a display on the operation display portion provided on the copying machine.

The aligning members 32 include the front-side aligning member and the rear-side aligning member which can move in the back and forth direction independently of each other. Thus, the sheets are aligned in the direction of the sheet width perpendicular to the conveying direction of the sheet bundle. When the user operates the buttons on the operation display portion 214 in the copying machine main body 1 shown in FIG. 2, the front side of the copying machine main body 1 where the user is standing (the side where the user can see the screen image as shown in FIG. 2) is here referred to as the front side and the opposite rear side as the rear side.

In FIG. 1, there are a stack tray 40 and a sample tray 41, which are used separately as the occasion demands. For example, the stack tray 40 located below is used to receive copy output and print output. The sample tray 41 located above is used to receive sample output, interrupt output, output at time of stack tray overflow, function sort output, and output in mixed job process. The two trays 40 and 41 are supported such that they are capable of self-moving in the vertical direction independently of each other.

A pivoting guide 26 is capable of swinging in the directions shown by arrows a, and an upper roller 29 is supported by the pivoting guide 26. When the pivoting guide 26 swings downward and comes to the closed position, the upper roller 29 and a lower roller 28, arranged on the process tray 25, jointly serve in a pair as bundle discharge rollers for discharging a sheet bundle onto the stack tray 40 along the process tray.

When a sheet is normally discharged onto the process tray 25, the pivoting guide 26 is placed in an open state (the state in which the bundle discharge rollers 28, 29 are separate from each other) as shown in FIG. 1, so that the pivoting guide 26 does not present an obstacle to the discharge and the fall of the sheets onto the process tray 25, and also to a subsequent aligning process. When a sheet bundle is discharged from the process tray 25 to the stack tray 40, the pivoting guide 26 moves to a closed state (the state in which the upper discharge roller 29 is in contact with the sheet bundle).

The flow of a sheet S in the above sheet processing apparatus 10 will be described next.

For example, when a staple sort mode is specified from the operation display portion 214 in the copying machine main body 1 shown in FIG. 2, a sheet S discharged from the copying machine main body 1 is sent to the sort path P by way of a pair of transfer rollers 21 and the buffer roller 22, and by switching a flapper (not shown).

The sheet S sent to the sort path P is discharged onto the process tray 25 by the discharge roller pair 24. The discharged sheet S slides down the process tray 25 on the sheet's own weight and also by the action of the return paddle 31, until the trailing end of the sheet comes into contact with the rear end aligning member 30. As a result, the trailing ends of the sheets are aligned. Furthermore, the sheets are aligned in the sheet width direction by the aligning members 32.

When all sheets of a first copy have been discharged onto the process tray 25 and aligned, the pivoting guide 26 goes down and the upper roller 29 comes to rest on the bundle of sheets to fix the sheet bundle. Then, the stapler 50 staples the sheet bundle. The sheet bundle which has been processed on the process tray 25 is discharged onto the stack tray 40 by the pair of bundle discharge rollers 28, 29.

The stapler 50 is arranged close to the rear end aligning members 30, and can move in the direction of the sheet width (the front-rear direction of the sheet processing apparatus). The stapler 50 staples the sheet bundle by driving staples into an end portion of the sheet bundle aligned along the rear end aligning member 30. The staple driving operation is driven by a DC brush motor (not shown), and, interlocked with this stapling operation, surplus portions of staples are cut off.

Figure 3A:
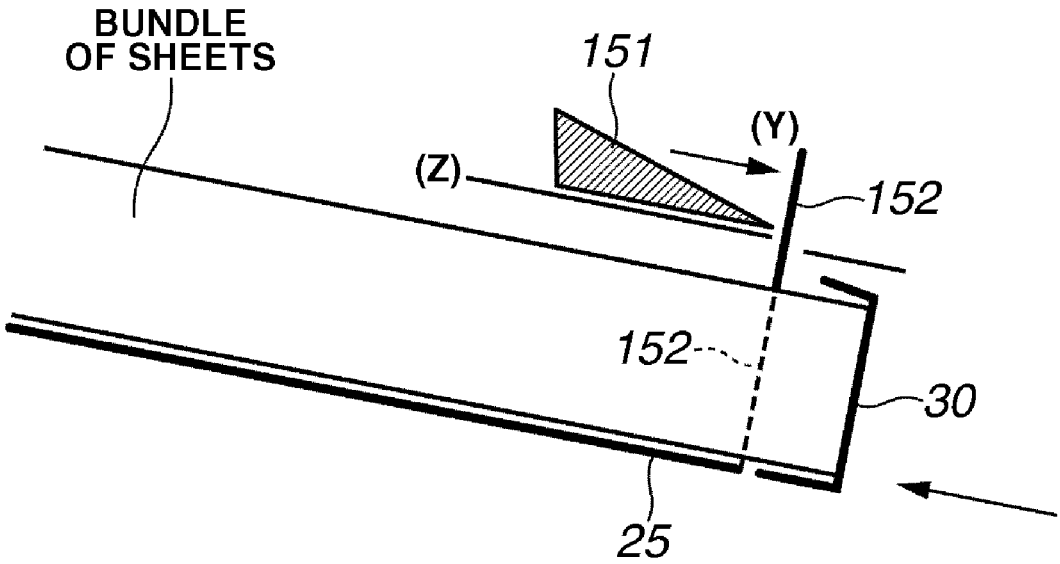
FIGS. 3A and 3B are diagrams illustrating a cutting mechanism mounted on a binding unit of the sheet processing apparatus.
Figure 3B:
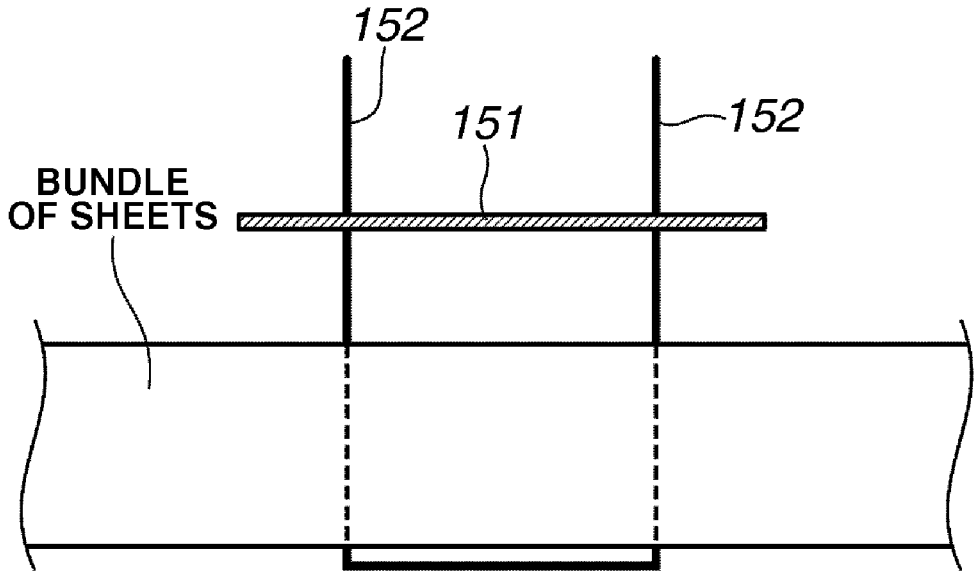

FIGS. 3A and 3B show a cutting mechanism for cutting off surplus end portions of staples. End portions of a staple 152 have passed through the sheet bundle, and a cutter portion 151 cuts off surplus end portions of the staple 152. This cutting mechanism is mounted on the binding unit 50A.

When a predetermined number of sheets are stacked on the process tray, the stapler (not shown) drives a staple 152 into a sheet bundle, and the end portions of the staple extend from the sheet bundle as shown in FIG. 3A.

Because the end portions of the staple 152 extending beyond the line (Z) are surplus made in a step of bending the staple, they are cut off by moving the cutter portion 151 in the direction of arrow (Y). As shown in FIG. 3B, by moving the cutter portion 151, the two surplus portions of the staple 152 are cut off almost simultaneously at a same distance from the top surface of the sheet bundle.

After the end portions are cut off by the cutter portion 151, the remaining portions of the staple 152 are bent and the stapling process is completed. The processes from the staple driving operation to the staple cutting and the end-portion bending are driven by a DC brush motor (not shown).

Figure 4:
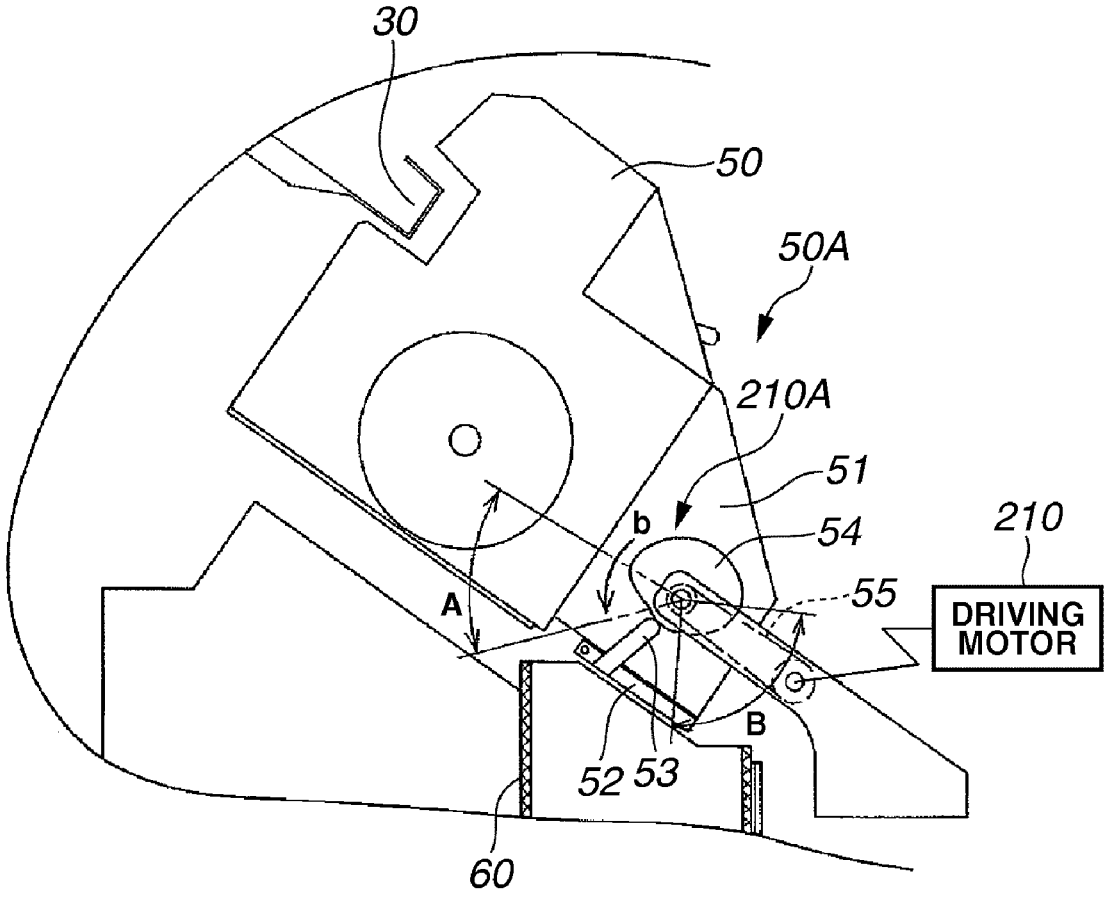
FIG. 4 is a diagram illustrating a structure for opening and closing the open-close lid mounted on the storage portion of the binding unit.

The end portions cut off as described are conveyed as surplus through a transfer pathway (not shown) and temporarily stored in a storage portion 51 provided in the binding unit 50A shown in FIG. 4. The cut-off tip portions of staples (hereafter referred to as cut-off portions) fall by gravity in the storage portion 51 and accumulate in the lower area of the storage portion 51.

An open-close lid 52 is provided which can be opened and closed at the bottom of the storage portion 51. The open-close lid 52 is closed to prevent cut-off staple portions from falling during a stapling operation. An opening lever 53 for opening and closing the open-close lid 52 is attached to the open-close lid 53, and is urged upward by a spring (not shown).

A release cam 54 pushes down the opening lever 53. This release cam 54 is rotated in the direction of an arrow b by a driving force transmitted from a driving motor 210 through a pulley belt 55 so that the opening lever 53 can be pushed down against the force of the spring. By pushing down the opening lever 53 by a lid opening and closing portion 210A including the release cam 54 and the driving motor 210, the open-close lid 52 can be opened. In this embodiment, the lid opening and closing portion 210A is arranged at the front side of the sheet processing apparatus, which is the home position of the binding unit 50A. The lid opening and closing portion 210A opens the open-close lid 52 above the staple waste box 60 which is similarly arranged at the front side of the sheet processing apparatus 10. The lid opening and closing portion 210A can also be provided on the binding unit 50A. By this arrangement, the open-close lid 52 can be opened or closed at any optional position.

When the cut-off staple portions stored in the storage has accumulated close to or reached a maximum capacity of the storage portion 51 during a stapling process (job), the storage portion 51 is moved above the staple waste box 60.

Figure 5:
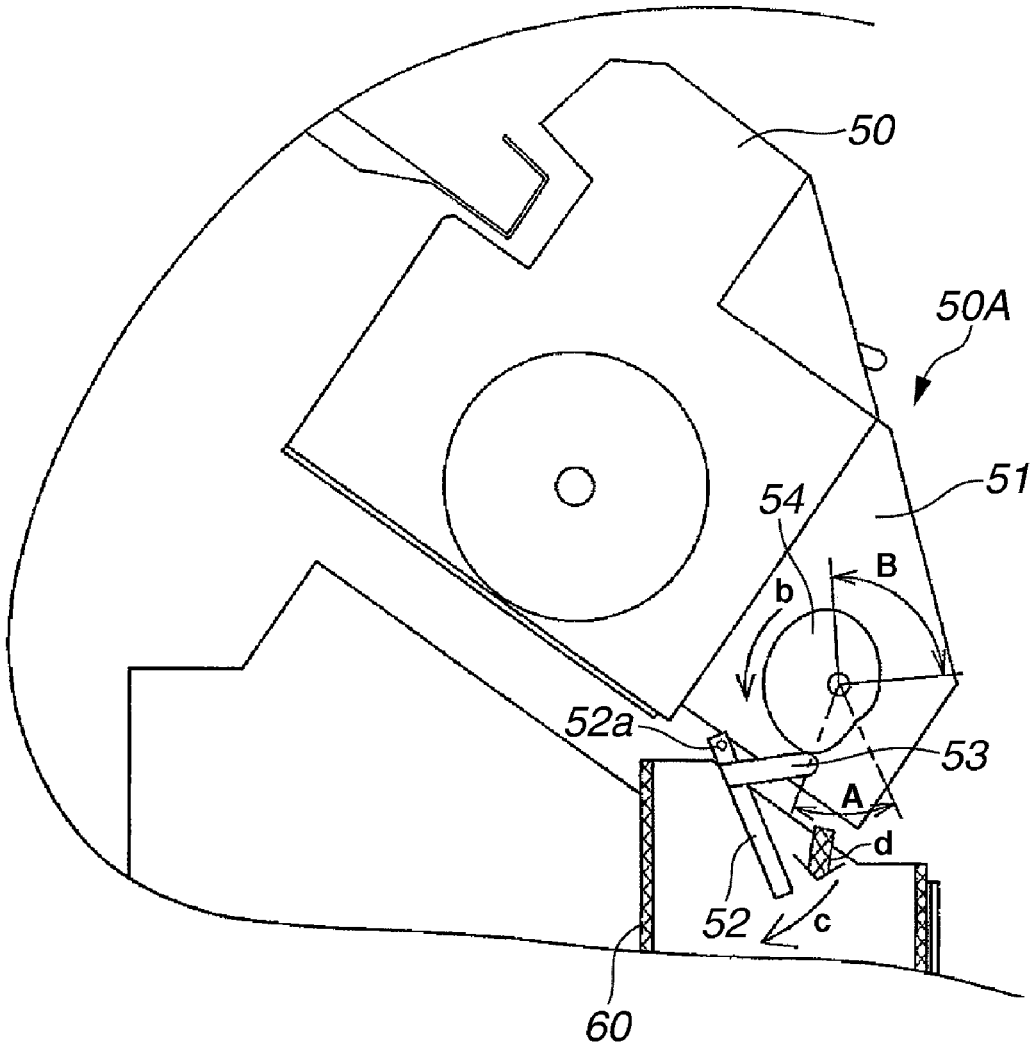
FIG. 5 is a diagram showing an opening motion of the open-close lid.

After this, when the release cam 54 is rotated, due to a shape of the release cam 54, the opening lever 53 is pushed down against the force of the spring as shown in FIG. 5. As a result, the open-close lid 52 rotates in the direction of an arrow c around an axis 52*a* serving as a fulcrum. Accordingly, cut-off portions of staple freely fall into the staple waste box 60 as shown in the direction of an arrow d.

Figure 6:
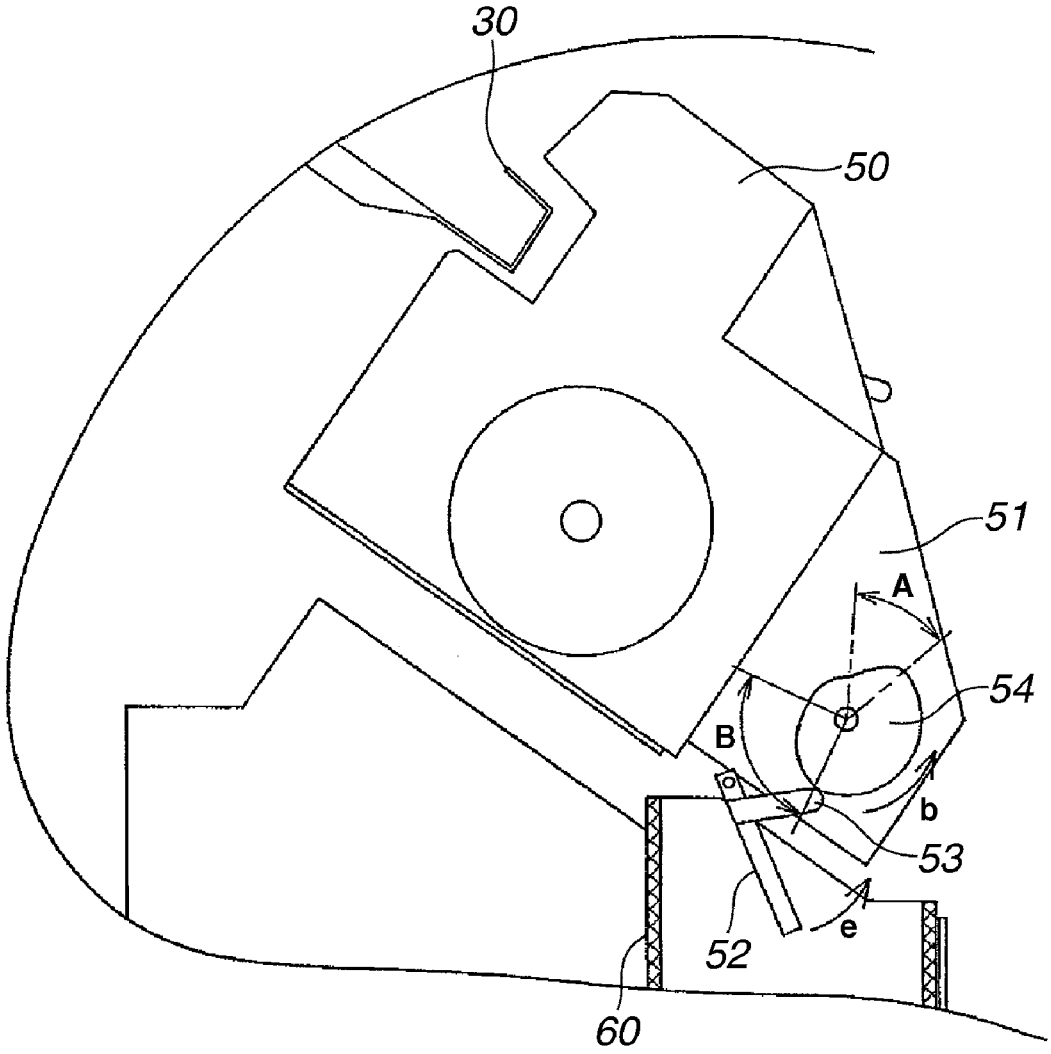
FIG. 6 is a diagram showing a closing motion of the open-close lid.

Subsequently, as shown in FIG. 3, when the release cam 54 further rotates and passes a point of action, the opening lever 53 rotates upward according to the shape of the release cam 54 and by the force of the spring. The open-close lid 52 turns in the direction of an arrow e in FIG. 6 and goes from the open state to a closed state as described with reference to FIG. 4. With respect to the release cam 54 shown in FIGS. 4 to 6, an angle A indicates a phase angle of the cam face when the open-close lid 52 transfers from the closed state to the open state, and an angle B indicates a phase angle of the cam face when the open-close lid 52 transfers from the open state to the closed state.

As described above, when the open-close lid 52 moves to the closed state, a lid open-close sensor 208 (shown in FIG. 11) detects the closed state of the open-close lid 52. The lid open-close sensor 208 is includes, for example, a micro-switch to detect the open and closed state of the open-close lid 52 which will be described below with reference to FIG. 11. When the open-close lid 52 moves to the closed state, the open-close lid 52 pushes down a micro-switch to change the signal. The micro-switch is arranged in the storage portion 51 at the open end side of the open-close lid 52.

Figure 7A:
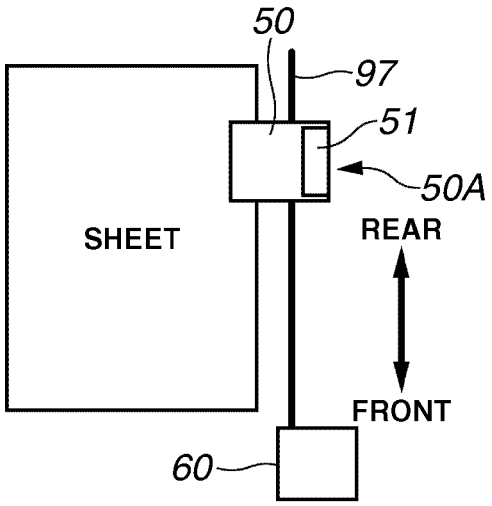
FIGS. 7A and 7B are diagrams illustrating relative positions of the binding unit and the staple waste box.
Figure 7B:
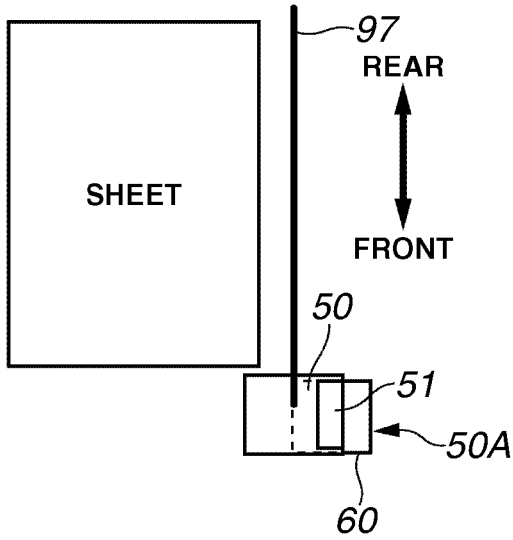

FIGS. 7A and 7B are diagrams showing a state when the storage portion 51 is moved above the staple waste box 60 as described above. FIG. 7A shows the state in which the stapler 50 is at rest in the rear side stapling position in the two-point stapling mode. Note that this stapler 50 is configured to move on a moving rail 97 in the front-rear direction (sheet-width direction) driven by a stapler moving motor. The stapler moving motor can be a stepping motor (not shown) which constitutes a moving portion.

FIG. 7B shows the state in which the storage portion 51 has moved above the staple waste box 60 integrally with the stapler 50 according to an amount of cut-off staple portions stored in the storage portion 51. When cut-off staple portions stored in the storage portion 51 are collected, the storage portion 51 is moved above the staple waste box 60. Then, the open-close lid 52 is opened to collect the cut-off staple portions into the staple waste box 60.

In this embodiment, the staple waste box 60 is arranged near the waiting position (home position) during a standby period for the job on the stapler 50. This waiting position is set at the foremost front of the sheet processing apparatus 10.

Figure 8:
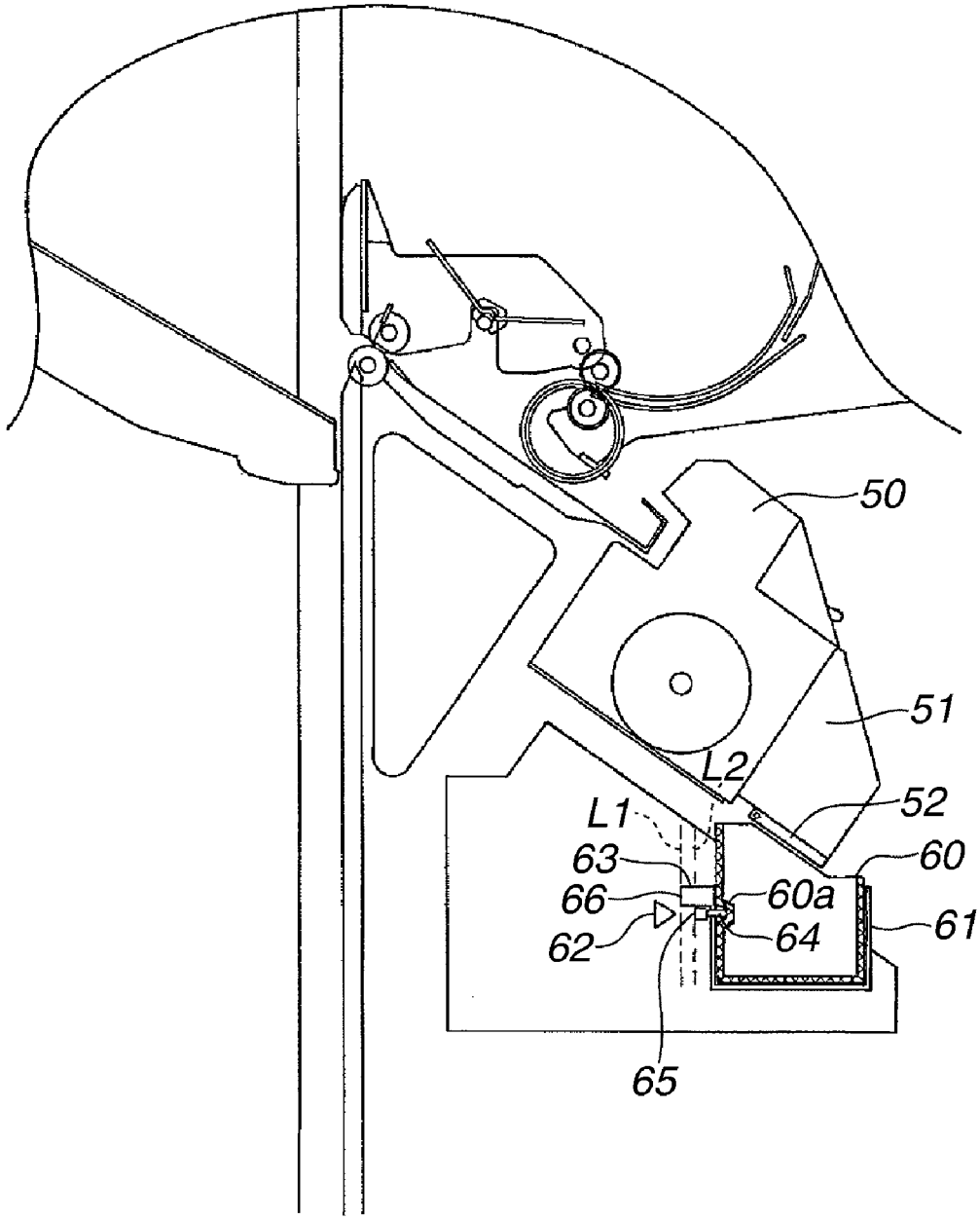
FIG. 8 is a diagram illustrating a structure for detecting the amount of cut-off staple portions in the storage portion and also for detecting if the staple waste box is set.

Meanwhile, the staple waste box 60 is supported by a support plate 61 as shown in FIG. 8. The support plate 61 can move in the vertical direction. When the staple waste box is filled with staple end portions, the support plate 61, while supporting the staple waste box 60, descends under the weight of the staple waste box 60. When the staple cut-off portions accumulated in the staple waste box 60 exceed a certain amount, the user is supposed to dismount the staple waste box 60 from the support plate 61 and dispose of the staple cut-off portions.

To efficiently dispose of cut-off portions of staples accumulated in the staple waste box 60, it is necessary to detect an amount of staple portions stored in the staple waste box 60. After the cut-off portions of stapes have been discarded, it is also necessary to check if the staple waste box 60 is set surely in the support plate 61.

To detect the amount of cut-off staple waste stored in the staple waste box 60, the support plate 61 is provided with a detection flag 63. The support plate 61 is also provided with a detection lever 64 for checking if the staple waste box 60 is set in the support plate 61.

In this embodiment, the staple waste box 60 is adapted to be set in the support plate 61 from the side, and the detection lever 64 is urged by a spring (not shown) in a direction opposite to the setting direction of the staple waste box 60.

Figure 9:
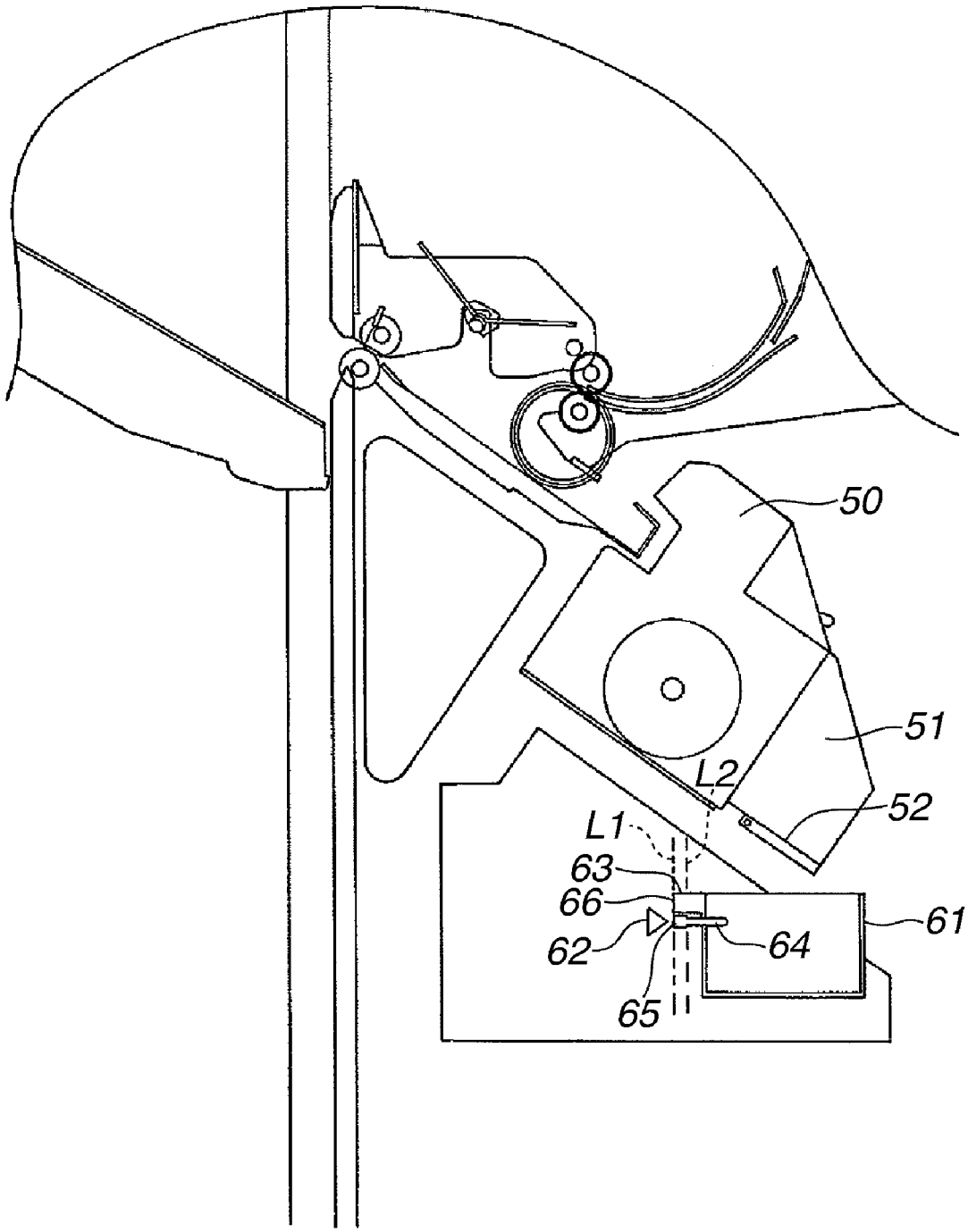
FIG. 9 is a diagram showing the sheet processing apparatus in a state where the staple waste box is not set.

Therefore, if the staple waste box 60 is not set in the support plate 61, the detection lever 64 can rotate in a direction that its distal end gets into the inside of the support plate as shown in FIG. 9, which will be described later. When the staple waste box 60 is set, the detection lever 64 rotates along a groove 60*a* on a side of the staple waste box 60 against the force of the spring in the direction in which the staple waste box 60 is set.

On the other hand, on the sheet processing apparatus side, a detecting sensor 62 is provided which detects the positions of the detection flag 63 and the detection lever 64 to determine the amount of staple end portions and detects whether the staple waste box 60 is set. In this embodiment, as the detecting sensor 62, a reflection type sensor is used to detect a state of the object by receiving different signals between when the detection object is in a predetermined position relative to the light-emitting surface and when it is not in the predetermined position.

For example, the detecting sensor 62 generates and outputs different signals between when the detection object is in the vicinity of line L1 adjacent to the detecting sensor 62, and when the detection object is in the vicinity of line L2 which is remote from the line L1. Hereinafter, a signal output when the detection object is in the vicinity of the line L1, is referred to as a first signal, and a signal output when the detection object is in the vicinity of the line L2 is referred to as a second signal.

For example, as shown in FIG. 9, when the staple waste box 60 is not set in the support plate 61, the detecting surface 65 of detection lever 64, which is not yet rotated, is in the vicinity of the line L1. In this case, a first signal is output from the detecting sensor 62.

Figure 10:
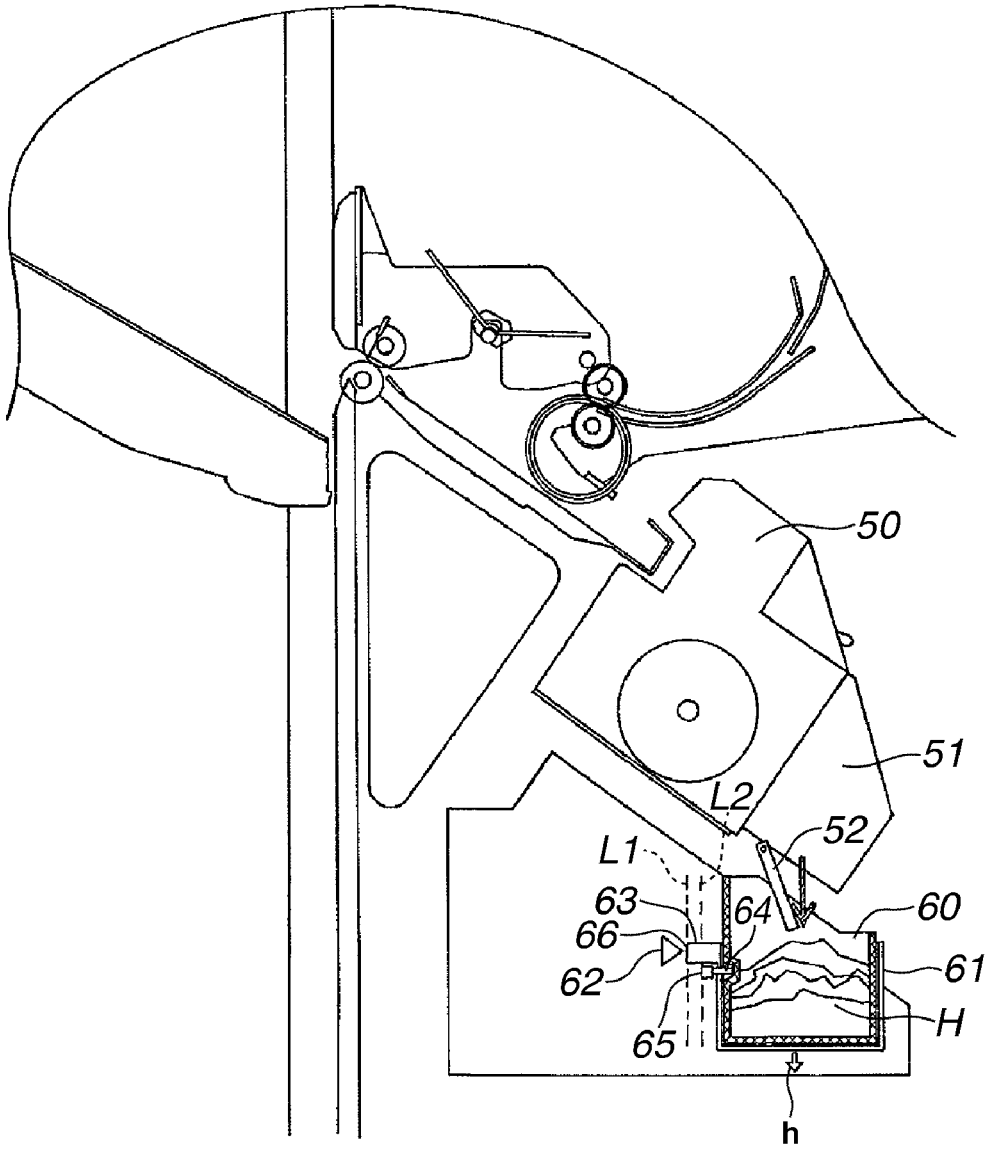
FIG. 10 is a diagram showing a state where the storage portion descends when cut-off staple portions are piled-up.

As shown in FIG. 10, when the staple waste box 60 and the support plate 61 descend as the cut-off portions H of staples accumulate in the staple waste box 60, along with them, the detecting surface 66 of the detection flag 63 also descends and comes to the vicinity of the line L1. In this case, a first signal is output from the detecting sensor 62.

FIG. 8 shows that the cut-off portions H of staples in the staple waste box 60 have not yet reached a predetermined amount, and the staple waste box 60 is set in the support plate 61. The detecting surface 65 of the detection lever 64 is rotated pressed by the staple waste box 60, and the detecting surface 65 of the detection lever 64 is in the vicinity of the line L2. In this case, a second signal is output from the detecting sensor 62.

Based on a detection result, when a first signal is received, a control portion 201 shown in FIG. 11 (which will be described below) causes the operation display portion 214 (refer to FIG. 2) to display a necessary message, such as an alert to the user. In this embodiment, one detecting sensor not only detects whether the staple waste box 60 is set but also detects the amount of cut-off portions H of staples in the staple waste box 60 so that the system configuration can be configured to be simple.

Figure 11:
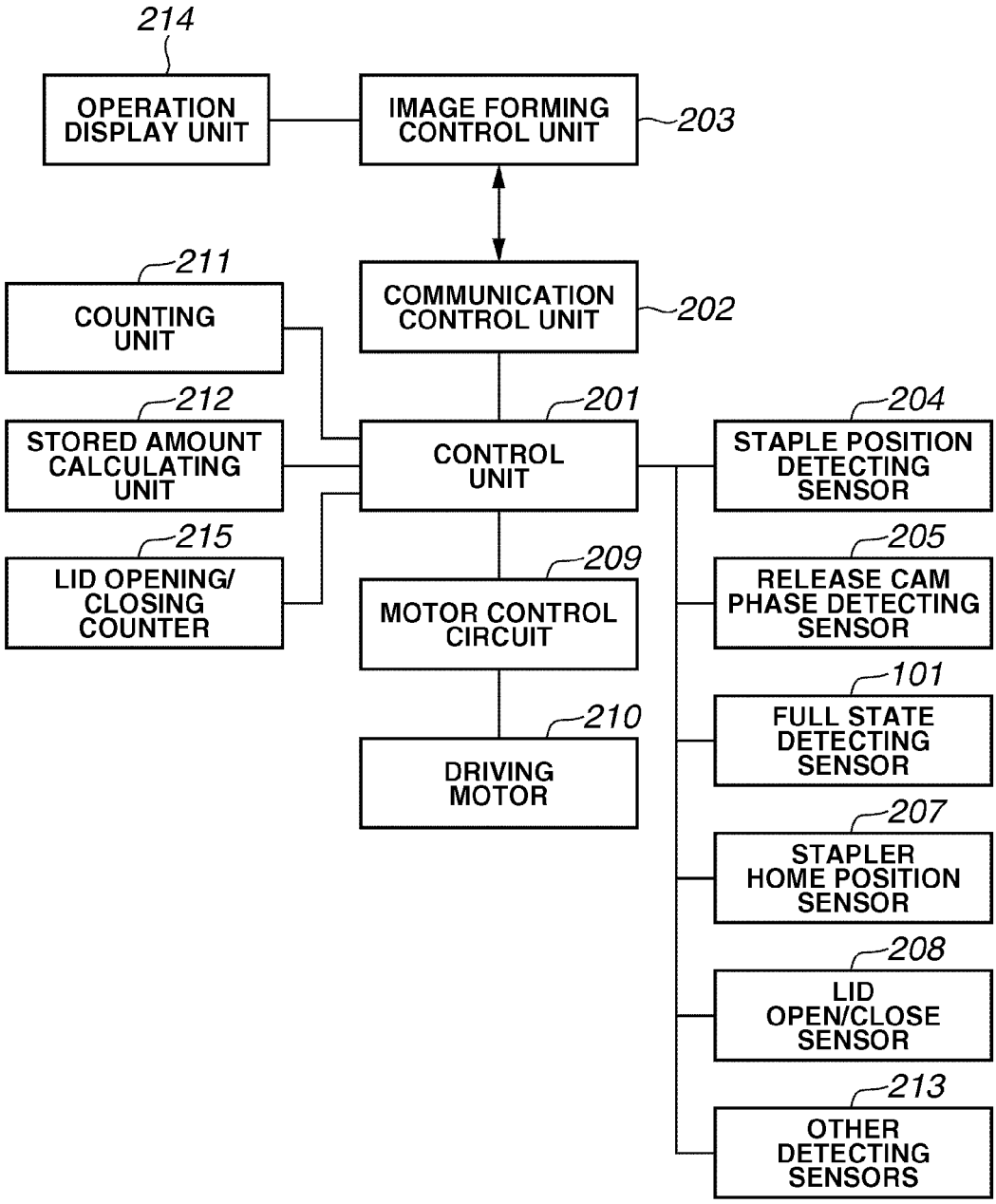
FIG. 11 is a block diagram of the sheet processing apparatus.

FIG. 11 is a control block diagram of a sheet processing apparatus 10 as described above. In FIG. 11, a control portion 201 controls the processes in the sheet processing apparatus 10. The control portion 201 includes a CPU, a ROM for storing programs and a weighting table, and a RAM used to temporarily store data (all not shown).

This control portion 201 receives signals from a staple position sensor 204, a release cam phase sensor 205, a full-state sensor 101, a stapler home position sensor 207, a lid open-close sensor 208, and other detecting sensors 213. The full-state sensor 101 is formed by a reflection type sensor similar to the above sensor 62 in FIGS. 8 to 10.

A communication control portion 202 controls communication between an image forming control portion 203 in the copying machine 1 and the sheet processing apparatus 10. A counting portion 211 counts a number of stapling times during a stapling job. A stored amount calculating portion 212 calculates an amount of cut-off staple portions in the storage portion 51 from, for example, a counting result of the counting portion 211 and a weighting table stored in the ROM (not shown). A lid open-close counter 215 counts a number of opening and closing operations of the lid 52.

The control portion 201 supplies a control signal to a motor control circuit 209 based on the above detection information. Based on this control signal, a motor control portion 209 generates a control signal for a driving motor 210 (refer to FIG. 4) and operates the driving motor 210 to rotate the release cam 54. Alternatively, a DC brush motor (not shown) can be driven to perform a stapler clinching motion in a stapling operation.

If the control portion 201 determines according to a signal from the lid open-close sensor 208 that the open-close lid 52 is not completely closed, as described below, the control portion 201 displays this information on the operation display portion 214 through the communication control portion 202 and the image forming control portion 203.

Meanwhile, in this embodiment, the capacity of the storage portion 51 for storing cut-off staple portions is set at 200 copies of a book. Therefore, the storage portion 51 can store cut-off staple portions when stapling 100 sheet bundles in two-point stapling mode, or 200 sheet bundles in one-point stapling mode. However, the number of copies that can be set for one job is larger than the above capacity. Therefore, if a set number of sheet bundles is too large for the storage portion 51 to store the staple cut-off portions, the cut-off portions can overflow from the storage portion 51 halfway in a stapling job.

Figure 12:
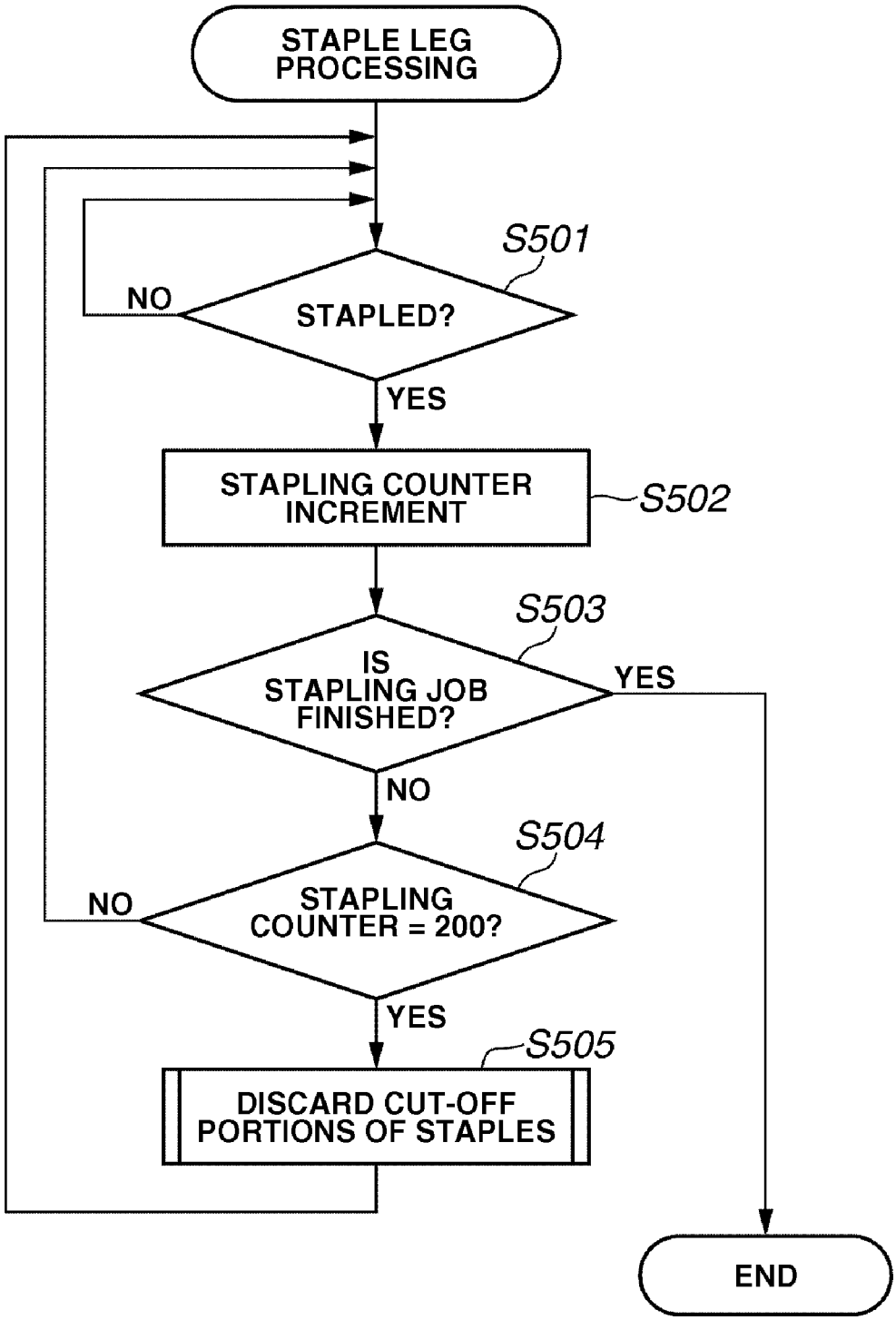
FIG. 12 is a flowchart illustrating a process of preventing cut-off staple portions from overflowing from the storage portion during the stapling job.

A process of preventing cut-off staple portions from overflowing from the storage portion 51 during a stapling job is described with reference to FIG. 12. In the present embodiment, control in performing this process is described with regard to a case where the process is carried out by the control portion 201. However, this process can also be controlled directly from the image forming control portion 203 in the copying machine main body 1 without using the control portion 201.

For example, when a staple sort mode is specified for a job from the operation display portion 214 shown in FIG. 2, it is determined whether a bundle of sheets stacked on the process tray 25 has been stapled (step S501). In this case, because the mode for stapling is in effect, a stapling operation is carried out. When the stapling operation has been carried out, the decision in S501 is YES, and the stapling counter at the counting portion 211 is incremented by one (step S502).

It is determined whether the stapling job has been completed (step S503). If the job has been completed (YES in step S503), the process is terminated. If there is a subsequent job (NO in step S503), it is determined whether the stapling counter has reached 200 (step S504).

When the stapling counter has reached 200 (YES in step S504), a process of discarding (collecting) cut-off staple portions (step S505) is performed, which will be described later. When the process of discarding the cut-off staple portions is completed, the process returns to step S501.

Figure 13:
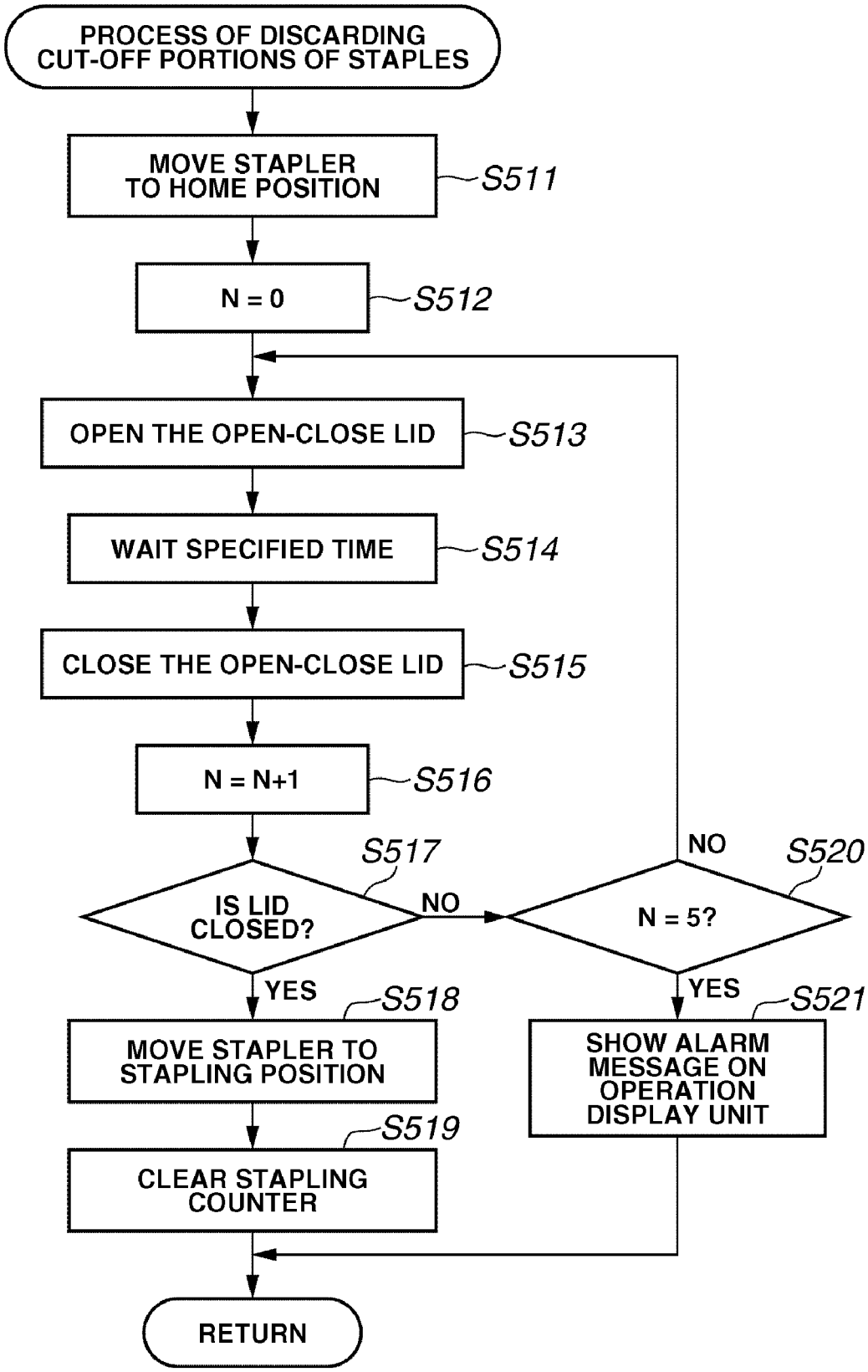
FIG. 13 is a flowchart illustrating a process of collecting cut-off staple portions from the storage portion into a staple waste box.

Referring to the flowchart in FIG. 13, a process of collecting the cut-off portions from the storage portion 51 into the staple waste box 60 is described.

When the stapling counter reaches 200, the stapler 50 is moved to its home position (refer to FIG. 7) (step S511). Note that the home position is set at the foremost front position of the sheet processing apparatus 10 in FIG. 1 as has been described. The stapler home position sensor 207 detects that the stapler 50 comes to the home position.

Next, the value (N) on the lid open-close counter 215 is set to 0 (refer to FIG. 11). The lid open-close counter 215 counts the number of an opening and closing operation of the open-close lid 52 (step S512). After this operation, when the stapler 50 reaches the home position, the driving motor 210 is started to open the open-close lid 52 (step S513). Then, a predetermined waiting time passes until the cut-off staple portions fall from the storage portion 51 into the staple waste box 60 (step S514). In this embodiment, a waiting period lasts two seconds, which is enough for all of the cut-off staple portions to fall from the storage portion 51 into the staple waste box 60. When a predetermined time passes, the open-close lid is closed (step S515).

The cut-off portions of staples fall from the storage portion 51 into the staple waste box 60. However, during a closing motion of the open-close lid 52, the cut-off portions of staples sometimes remain adhering to the open-close lid and get caught between the open-close lid 52 and the storage portion 51. In this case, since the open-close lid 52 cannot be completely closed, a gap appears between the open-close lid 52 and the storage. If the next stapling operation is performed under this condition, cut-off staple portions that are newly accumulated can come out through the gap.

For this reason, in this embodiment, if it is determined that the open-close lid 52 is still open, the control portion 201 controls the above-described lid opening and closing portion 210A to perform an opening and closing operation of the open-close lid 52 five times at most. By repeating an opening and closing of the open-close lid 52, the open-close lid 52 is vibrated enough to cause the cut-off staple portions adhering to the open-close lid to fall into the staple waste box 60.

After the open-close lid is closed, the lid open-close counter is incremented (step S516). Then, the above-described lid open-close sensor 208 determines whether the open-close lid 52 is closed (step S517). If it is determined that the open-close lid 52 is closed (YES in step S517), the stapler 50 is again moved to the stapling position (step S518) and is set ready for a subsequent stapling job. After this operation, the stapling counter is cleared (step S519).

On the other hand, if it is determined that the open-close lid 52 is not closed, in other words, the open-close lid 52 is in an open state (NO in step S517), the lid open-close counter 215 showing the number of times of opening and closing the open-close lid 52 is checked. If the value on the lid open-close counter 215 has not reached five (5) (NO in step S520), the process returns to step S513. After the opening motion of the open-close lid 52 is performed, the closing motion of the open-close lid 52 is carried out (step S515).

When the number of times of opening and closing the open-close lid 52 has reached five (5) (YES in step S520), in other words, when the open-close lid 52 cannot be closed even if the opening and closing motion has been repeated five times, an alarm message appears on the operation display portion 214, urging the operator to check the cut-off staple portions in the storage portion 51 (step S521). Thus, cut-off staple portions are disposed of before the capacity of the storage portion 51 is exceeded, so that the cut-off portions of staples are prevented from overflowing from the storage portion 51.

When the job is completed, the stapler 50 returns to the home position, and the stapling counter is cleared. After this operation, the cut-off staple portions accumulated in the storage portion 51 are collected in the staple waste box 60, and the stapler is set ready for the next job. By this process, the storage portion 51 is emptied before the next job is started.

Thus, after the cut-off portions H of staples have been collected from the storage portion 51 into the staple waste box 60, if it is detected that the open-close lid 52 is not closed, the opening and closing operation of the open-close lid 52 is retried. Accordingly, the cut-off staple portions adhering to the open-close lid 52 can fall into the staple waste box 60. Therefore, the open-close lid 52 can be closed surely, and as a result, the cut-off staple portions can be prevented from coming out through the gap between the storage portion 51 and the open-close lid 52, so that the ease of use of the stapler is improved.

In the foregoing description, if it is detected that the open-close lid 52 is open, an operation of opening and closing the open-close lid 52 is carried out five times. In each operation of opening and closing the lid 52, first the open-close lid 52 is opened and after waiting a certain period of time, the open-close lid 52 is closed.

However, an embodiment of this invention is not limited to the above-described process. The operation of opening and closing the open-close lid 52 can be carried out, for example, five times continuously. During the operation, cut-off staple portions adhering to the open-close lid 52 can fall into the staple waste box 60.

Figure 14:
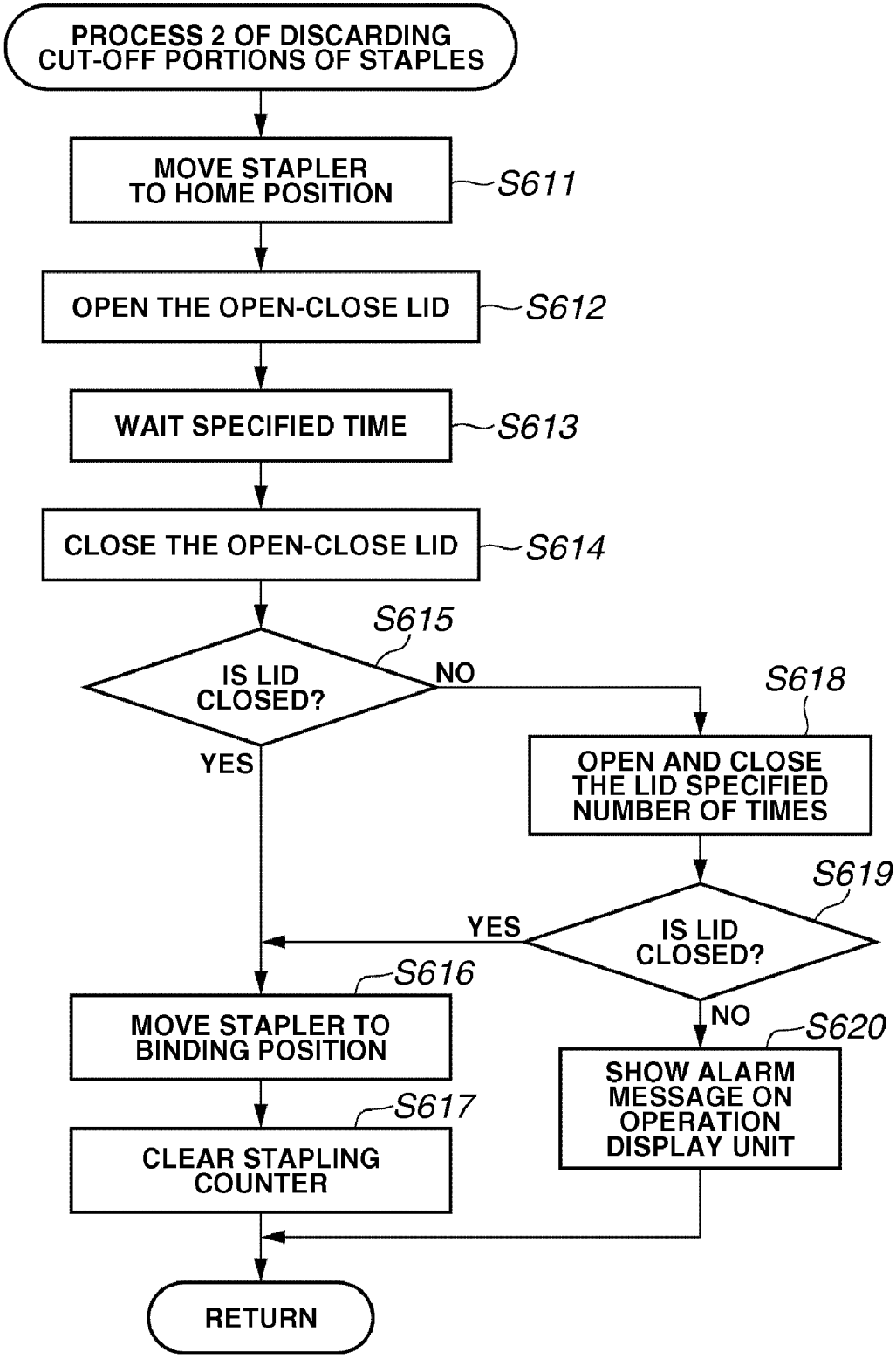
FIG. 14 is a flowchart illustrating another process of causing cut-off staple portions adhering to the open-close lid to fall into the staple waste box.

Another process is described with reference to the flowchart in FIG. 14 in which cut-off staple portions adhering to the open-close lid 52 can fall into the staple waste box 60.

In this case, when the stapling counter reaches 200, to begin with, the stapler 50 is moved to the home position (step S611). Then, when the stapler 50 reaches the home position, the open-close lid 52 is opened (step S612). A predetermined waiting time passes until cut-off staple portions fall from the storage portion 51 into the staple waste box (step S613). Then, the open-close lid 52 is closed (step S614).

Next, it is determined whether the open-close lid 52 is closed (step S615). When the open-close lid 52 is closed (YES in step 615), the stapler 50 is again moved to the stapling position (step S616) to be ready for a subsequent stapling job. Then, the stapling counter is cleared (step S617).

On the other hand, if it is determined that the open-close lid 52 is not closed (NO in step S615), the open-close lid 52 is continuously opened and closed a predetermined number of times (five times in this embodiment) (step S618). Then, it is determined whether the open-close lid 52 is closed (step S619). At this time, if it is determined that the open-close lid 52 is not closed (NO in step S619), an alarm message is displayed on the operation display portion 214, urging the operator to check the cut-off staple portions in the storage portion 51 (step S620). However, when it is determined that the open-close lid 52 is closed (YES in step S619), the process returns to S616.

In the above description, in order to detect the amount of cut-off staple portions stored in the storage portion 51, detection is performed based on the position of the cut-off staple waste box 60 as shown in FIG. 8.

Figure 15:
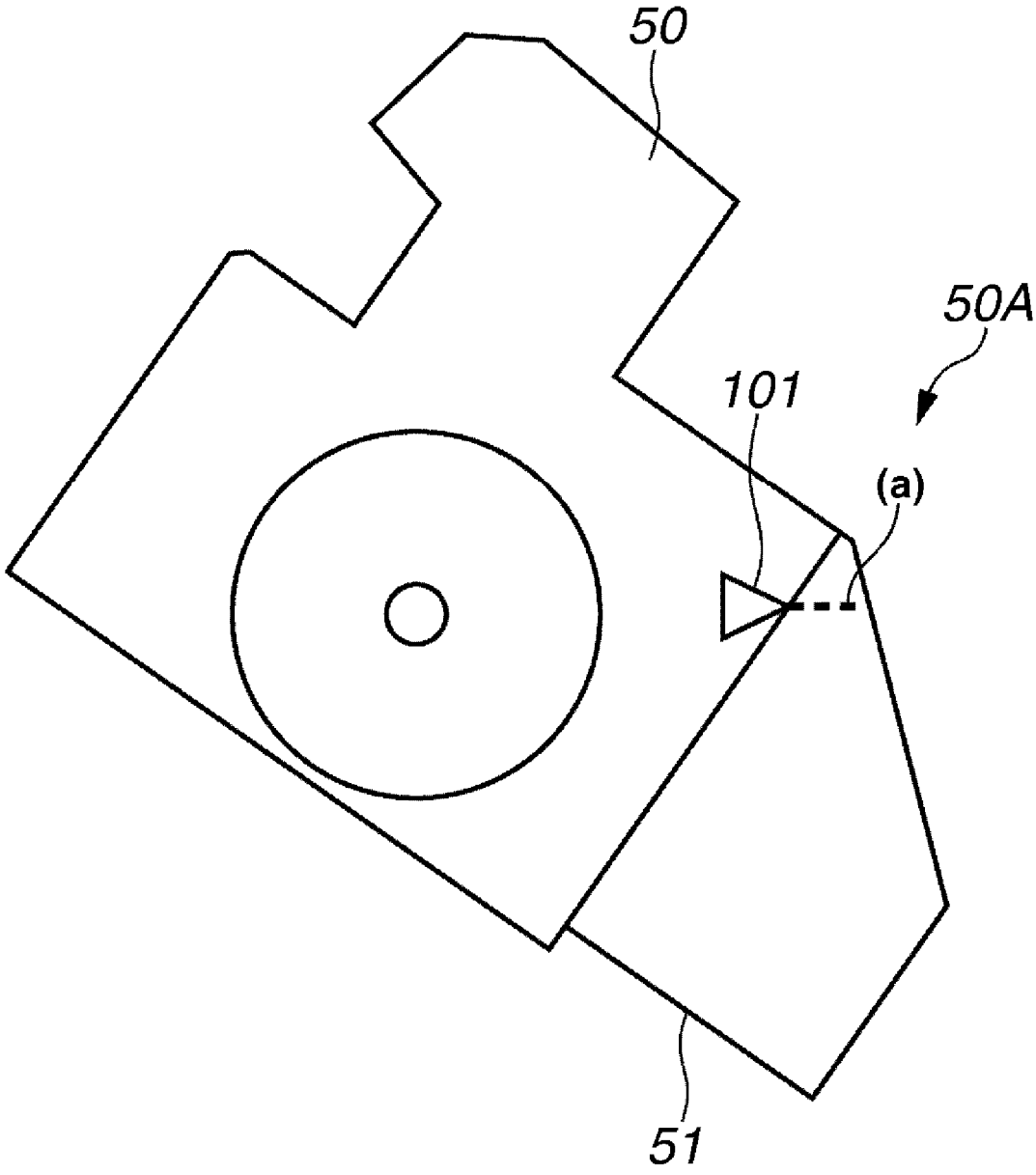
FIG. 15 is a diagram illustrating another structure of a full-state sensor to detect the amount of cut-off staple portions stored in the storage portion.

However, this invention is not limited to the above-mentioned embodiment. As shown in FIG. 15, for example, the amount of cut-off staple portions stored in the storage portion 51 can be determined directly by the full-state sensor 101 when the sensor 101 detects a dotted line (a) which indicates the top of the cut-off portions H of staples. In this case, as the full-state sensor 101, a reflection type sensor as described above is used, but the other type of a sensor can also be used.

Figure 16:
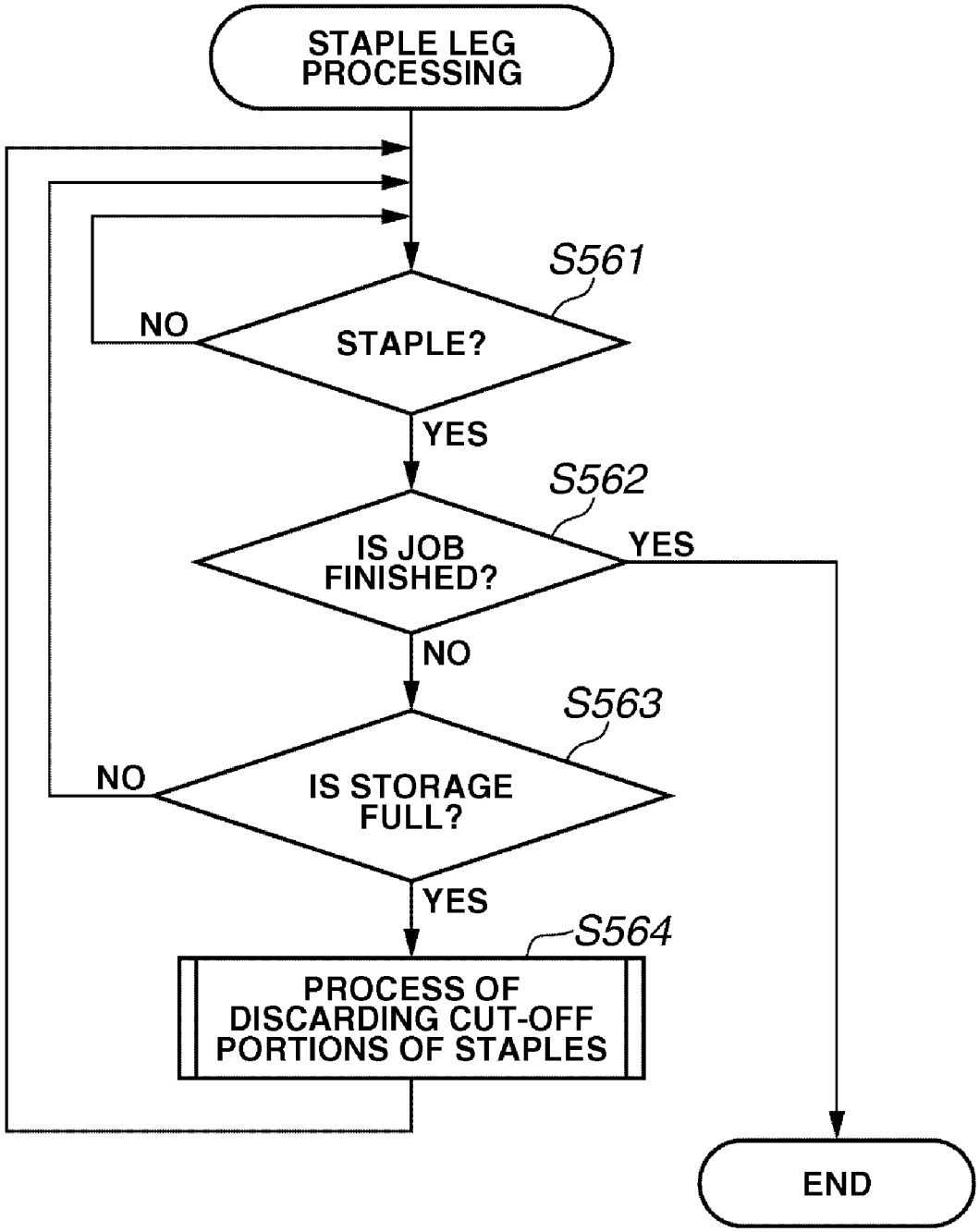
FIG. 16 is a flowchart illustrating a process of collecting cut-off staple portions using the full-state sensor.

A process of collecting cut-off staple portions using this full-state sensor 101 is described with reference to the flowchart in FIG. 16.

When the staple sort mode is specified for a stapling job from the operation display portion 214 as shown in FIG. 2, it is determined whether stapling has been performed on a bundle of sheets stacked on the process tray 25 (step S561). In this case, since the specified mode is stapling, the sheet bundle is stapled. When stapling is completed (YES in step S561), it is determined if the stapling job is finished (step S562).

When the job is finished (YES in step S562), the process is terminated. If there is a subsequent job (NO in step S562), the full-state sensor 101 determines whether the storage portion 51 is full (step S563). The full-state sensor 101 determines that the storage portion 51 is full when it detects the dotted line (a) that indicates the top of the cut-off staple portions in FIG. 15.

When the storage portion 51 is determined to be full (YES in step S563), a process of discharging (collecting) the cut-off staple portions is carried out (step S564). When the process of discharging the cut-off staple portions is completed, the process returns to step S561. The process of discarding the cut-off staple portions in step S564 is similar to the process from steps S511 to S516 described in the flowchart in FIG. 13. If the storage portion 51 is not full (NO in step S5623), the process returns to step S561.

Figure 17:
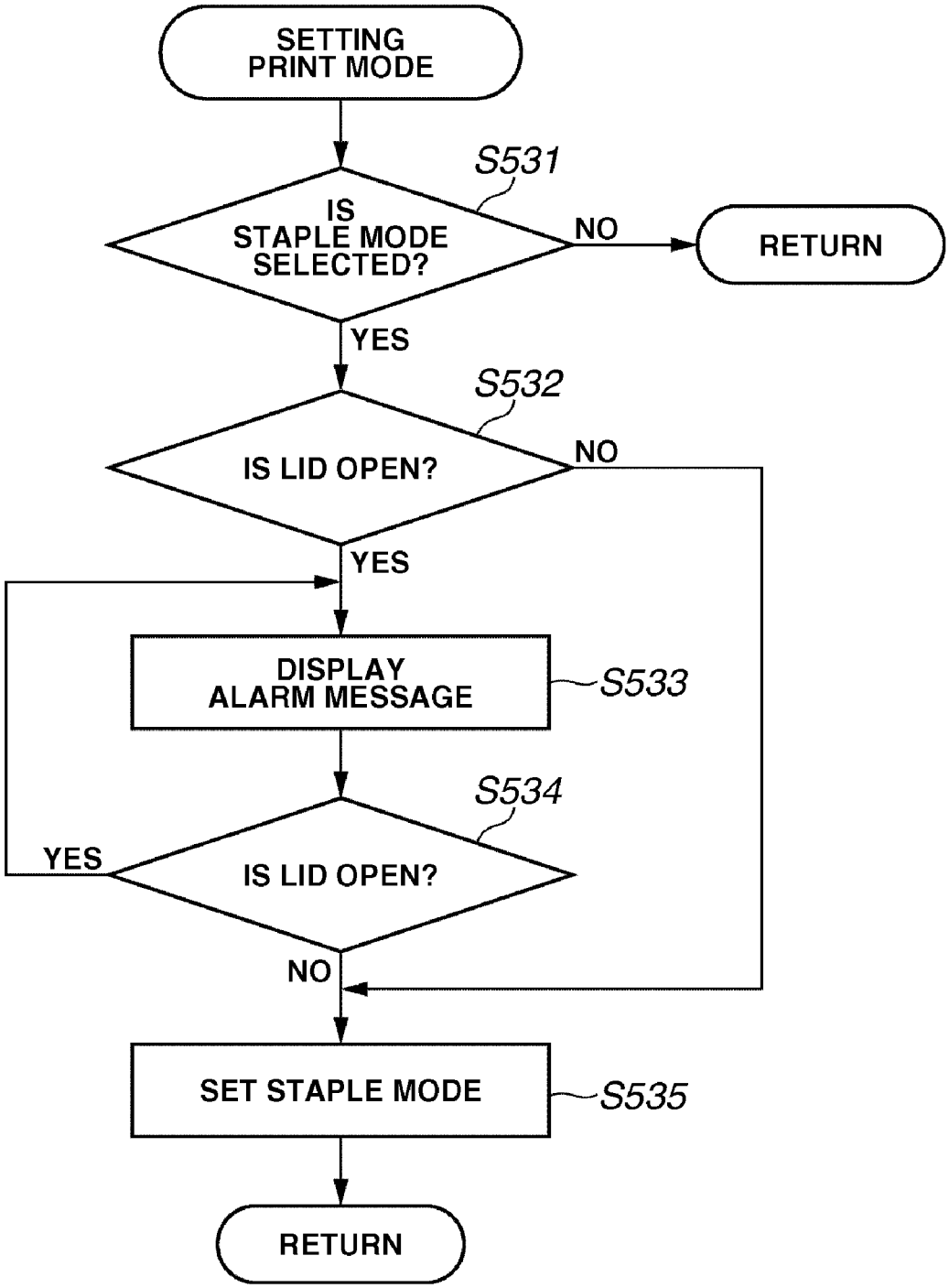
FIG. 17 is a flowchart illustrating a process of detecting closed-state of the open-close lid when the staple sort mode is selected in the sheet processing apparatus.
Figure 18:
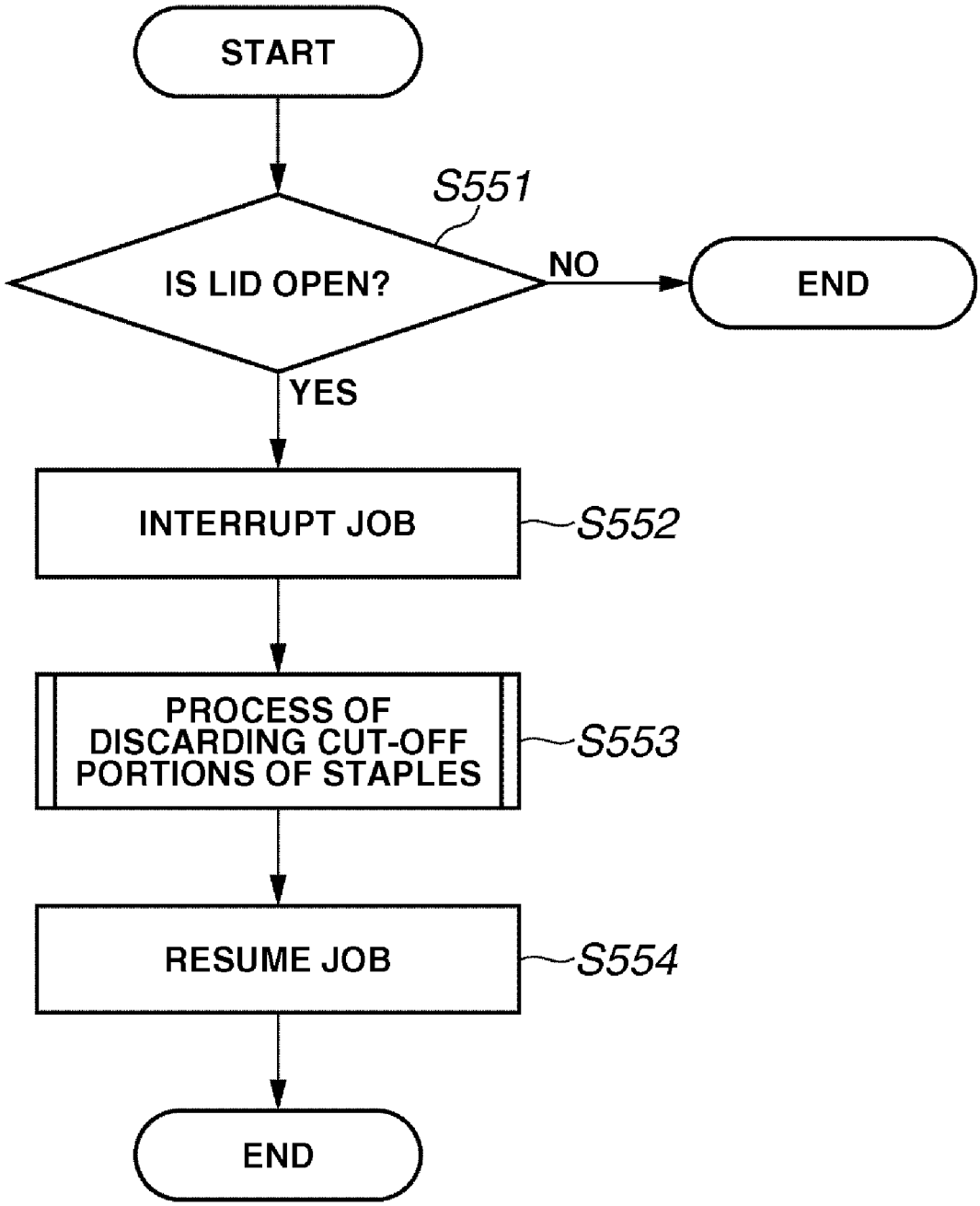
FIG. 18 is a flowchart illustrating a process when the open-close lid opens while the sheet processing apparatus is carrying out a stapling job.

The process of detecting the closed state of the open-close lid 52 when the staple sort mode has been selected on the operation display portion 214 is described with reference to the flowchart in FIG. 17.

It is determined whether the staple sort mode has been selected (step S531). If the staple sort mode has not been selected (NO in step S531), this process is terminated. On the other hand, if the staple sort mode has been selected (YES in step S531), it is determined whether the open-close lid 52 is open (step S532).

If the open-close lid 52 is closed (NO in step S534), the staple sort mode is set (step S535). On the other hand, if it is determined that the open-close lid 52 is open though the closing motion of the open-close lid 52 has been performed (YES in step S532), the alarm message as shown in FIG. 2, for example, is displayed on the operation display portion 214 (step S533).

Then, it is again determined whether the open-close lid 52 (step S534) is closed. If the open-close lid 52 remains open (YES in step S534), the process returns to step S533. When it is determined that the open-close lid is closed (NO in step S534) after the user removes the cut-off staple portions adhering to the open-close lid 52, the staple sort mode is set (step S535). By performing those steps in the stapling operation, the open-close lid 52 can be prevented from remaining open.

Incidentally, if the open-close lid 52 opens for some reason while a stapling job is underway, the cut-off staple portions are scattered from the storage portion 51. Therefore, if the open-close lid 52 opens while a stapling job is being carried out, the process shown in FIG. 8 is executed.

If the lid open-close sensor 208 determines that the open-close lid 52 is open while a stapling job is being carried out (YES in step S551), the job underway is suspended (step S552). Then, the process of disposing of the cut-off staple portions is carried out (step S553). Since this process has been already described, its description is omitted here. Next, the suspended job is resumed (step S554).

Thus, when it is determined that the open-close lid 52 is open during the execution of the stapling job, the job is suspended. The job is resumed after the open-close lid 52 is closed, so that the cut-off staple portions are prevented from scattering from the storage portion 51.

In this embodiment, when cut-off staple portions have piled up in the staple waste box 60, the user takes out the staple waste box 60 by pulling the staple waste box 60 from the sheet processing apparatus 10 in the direction to the front side, and discards the cut-off staple portions. In order to improve the operability of the apparatus, the range of opening and closing motion of the open-close lid 52 should not interfere with the dismounting direction of the staple waste box 60.

Figure 19:
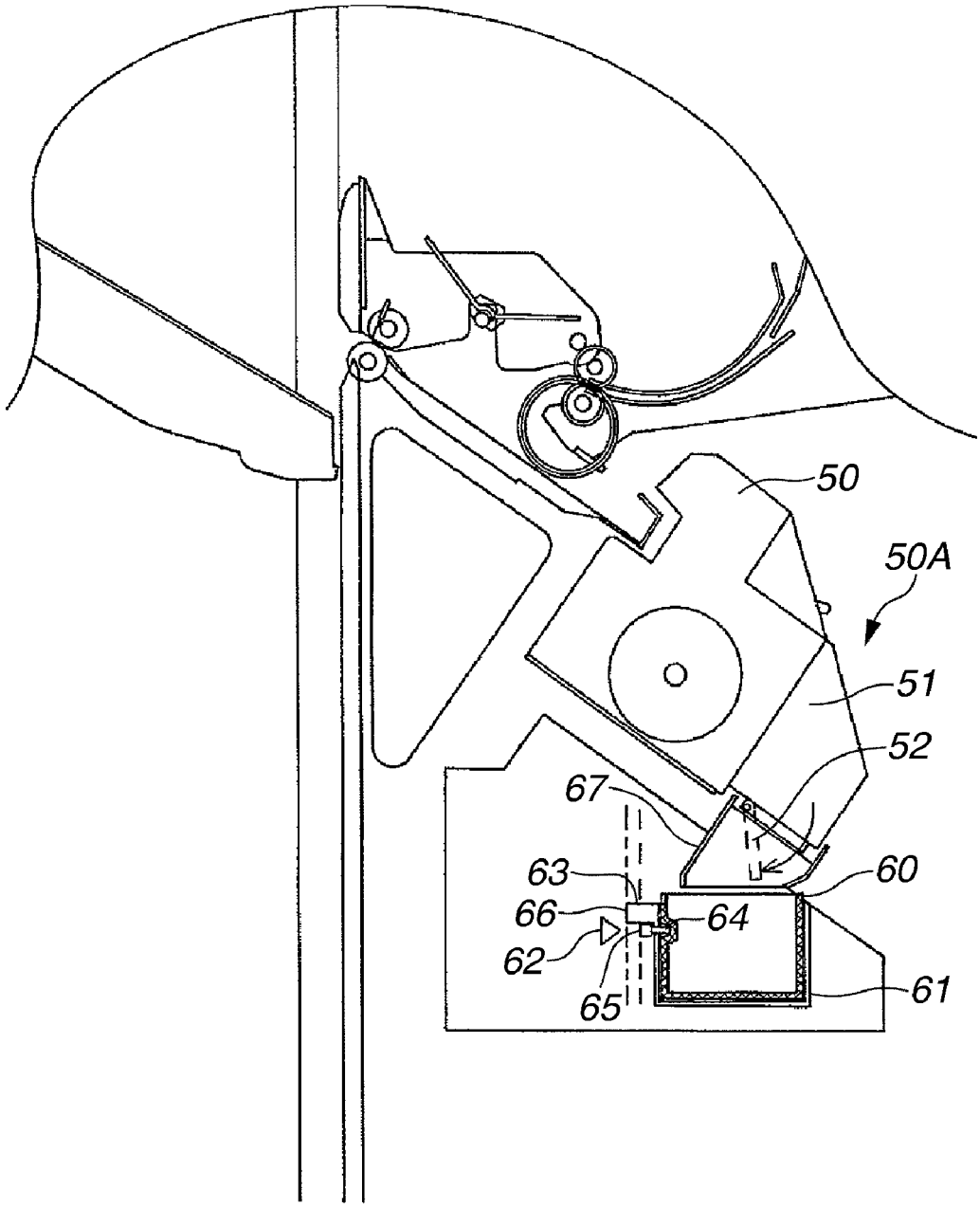
FIG. 19 is a diagram illustrating another structure of the binding unit.
Figure 20:
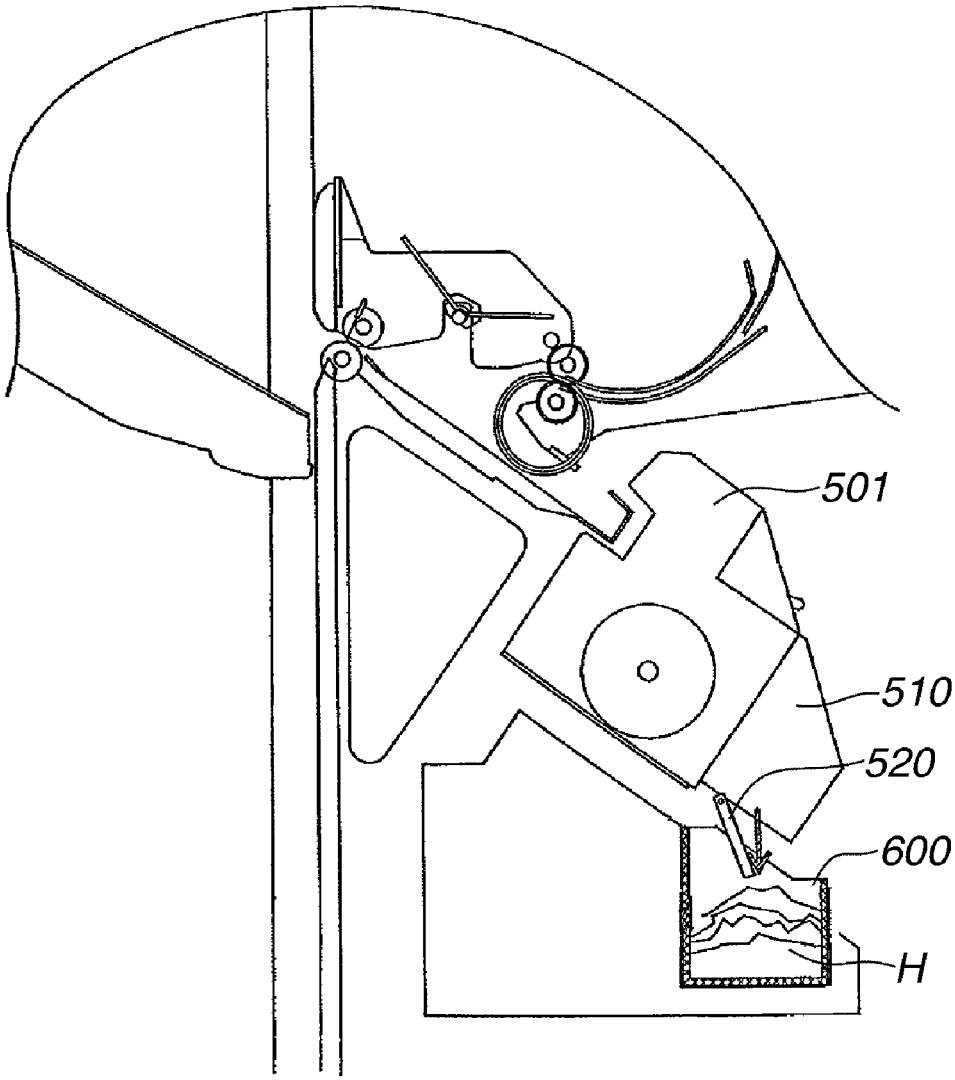
FIG.20 (PRIOR ART)
FIG. 20 is a diagram illustrating storage and collection of cut-off end portions of staples in a conventional sheet processing apparatus.

To this end, an intermediate fixing guide 67 can be provided between the storage portion 51 and the staple waste box 60 as shown in FIG. 19, so that the open-close lid 52 can open and close within the intermediate fixing guide 67. By this arrangement, the staple waste box 60 can be easily pulled out regardless of the state of the open-close lid 52, and thus, the ease of use of the stapler 50 and the staple waste box 60 are improved.

In the above description, a micro-switch is used as an example for the lid open-close sensor 208, but it can be configured such that when the open-close lid 52 is closed completely, a flag is detected. Further, an optical sensor can be used for the lid open-close sensor 208, which has a light-emitting portion and a light-receiving portion arranged respectively at the front side and the rear side of the sheet processing apparatus 10. In this configuration, the open and closed states of the open-close lid 52 can be monitored. Furthermore, in the foregoing description, the driving motor 210 is used as an example for the lid opening and closing portion 210A to drop the cut-off staple portions from the open-close lid 52. However, a vibration source can be installed to vibrate the open-close lid 52 when the open-close lid 52 is open.

While the present invention has been described with reference to exemplary embodiments, it is to be understood that the invention is not limited to the disclosed exemplary embodiment. The scope of the following claims is to be accorded the broadest interpretation so as to encompass all modifications, equivalent structures, and functions.

This application claims priority from Japanese Patent Application No. 2006-032882 filed Feb. 9, 2006, which is hereby incorporated by reference herein in its entirety.

What is claimed is:

1. A sheet processing apparatus, comprising:

a stapler configured to staple a sheet bundle by driving a staple into the sheet bundle;

a cutting mechanism, mounted to the stapler, configured to cut off end portions of staples driven into the sheet bundle;

a storage portion mounted to the stapler and configured to store cut-off end portions of staples;

a lid, mounted to the storage portion, capable of opening and closing;

an open and closed state detecting portion configured to detect open and closed states of the lid;

a collecting portion configured to collect the cut-off end portions of staples from the storage portion;

a lid opening and closing portion configured to perform a lid opening and closing operation of a lid opening operation that opens the lid when the cut-off end portions of staples are collected from the storage portion to the collecting portion and then a lid closing operation; and a control portion configured to control the lid opening and closing portion, wherein after the lid opening and closing portion has performed the lid opening and closing operation, if the open and closed state detecting portion detects that the lid is not closed, responsive thereto, the control portion controls the lid opening and closing portion to repeat the lid opening and closing operation.

2. The sheet processing apparatus according to claim 1, wherein after the lid opening and closing portion has performed the lid opening and closing operation, if the open and closed state detecting portion detects that the lid is not closed, the lid opening and closing portion repeats the lid opening and closing operation plural times, such that after a certain period of time passes since performing the opening operation of the lid, and then the closing operation.

3. The sheet processing apparatus according to claim 1, wherein after the lid opening and closing portion has performed a lid opening and closing operation, if the open and closed state detecting portion detects that the lid is not closed, the lid opening and closing portion continuously repeats the lid opening and closing operation plural times.

4. The sheet processing apparatus according to claim 1, wherein when the open and closed state detecting portion detects that the lid is not closed, the stapler is prohibited from performing a stapling operation.

5. The sheet processing apparatus according to claim 1, further comprising a display portion configured to display a state of the lid, wherein in a case in which after the lid opening and closing operation has been repeated and the open and closed state detecting portion detects that the lid is not yet closed, the display portion indicates that the lid is not closed.

6. A sheet processing apparatus, comprising:

a binding unit including:

a stapler configured to staple a bundle of sheets by driving a staple into the sheet bundle;

a cutting mechanism configured to cut-off end portions of the staples driven into the sheet bundle;

a storage portion configured to store cut-off end portions of staples;

a lid, mounted to the storage portion, capable of opening and closing; and an open and closed state detecting portion configured to detect an open and closed state of the lid;

a collecting portion configured to collect cut-off end portions of staples from the storage portion;

a lid opening and closing portion configured to perform a lid opening and closing operation of a lid opening operation that opens the lid when the cut-off end portions of staples are collected from the storage portion to the collecting portion and then a lid closing operation; and a control portion configured to control the lid opening and closing portion, wherein the control portion controls so that after the lid opening and closing portion has performed the lid opening and closing operation, if the open and closed state detecting portion detects that the lid is not closed, responsive thereto, the control portion controls the lid opening and closing portion to repeat the lid opening and closing operation.

7. The sheet processing apparatus according to claim 6, wherein after the lid opening and closing portion has performed the lid opening and closing operation, if the open and closed state detecting portion detects that the lid is not closed, the lid opening and closing portion repeats the lid opening and closing operation plural times, such that after a certain period of time passes since performing the opening operation of the lid, and then the lid closing operation.

8. The sheet processing apparatus according to claim 6, wherein after the lid opening and closing portion has performed a lid opening and closing operation, if the open and closed state detecting portion detects that the lid is not closed, the lid opening and closing portion continuously repeats the lid opening and closing operations plural times.

9. The sheet processing apparatus according to claim 6, wherein when the open and closed state detecting portion detects that the lid is open, the stapler is prohibited from performing a stapling operation.

10. The sheet processing apparatus according to claim 6, further comprising a moving portion configured to move the binding unit to a position for stapling a sheet bundle and to a position for collecting the cut-off staple portions from the storage portion into the collecting portion, wherein when the binding unit performs the stapling operation, if the open and closed state detecting portion detects that the lid is not closed, the moving portion moves the binding unit to the position where the cut-off staple portions stored in the storage portion are to be collected into the collecting portion.

11. The sheet processing apparatus according to claim 10, wherein based on a capacity of the storage portion to store the cut-off staple portions, the moving unit moves the binding unit to the position where the cut-off staple portions stored in the storage portion are to be collected into the collecting portion, and wherein after the lid opening and closing portion has performed the lid opening and closing operation, if the open and closed state detecting portion detects that the lid is not closed, the lid opening and closing portion repeats the lid opening and closing operation.

12. The sheet processing apparatus according to claim 10, wherein the position, where the cut-off staple portions stored in the storage portion are collected into the collecting portion, is a home position of the binding unit.

13. The sheet processing apparatus according to claim 6, further comprising a display portion configured to display a status of the binding unit, wherein in a case where after the lid opening and closing operation have been repeated, if the open and closed state detecting portion detects that the lid is not yet closed, the display portion performs display such that the lid is in the open state.

14. An image forming apparatus, comprising:

an image forming portion configured to form an image on a sheet; and the sheet processing apparatus according to claim 1, the sheet processing apparatus configured to process a sheet having an image formed thereon by the image forming portion.

15. An image forming apparatus, comprising:

an image forming portion configured to form an image on a sheet; and the sheet processing apparatus according to claim 6, the sheet processing apparatus configured to process a sheet having an image formed thereon by the image forming portion.

* * * * *